United States Patent [19]

Joyce

[11] Patent Number: 4,509,640

[45] Date of Patent: Apr. 9, 1985

[54] CARTON WITH SEPARATERS, ITS BLANK AND APPARATUS FACILITATING ITS ERECTION FOR USE

[76] Inventor: Michael F. Joyce, 25 Rangewood Ave., Reading RG3 3NN, England

[21] Appl. No.: 268,087

[22] Filed: May 28, 1981

[30] Foreign Application Priority Data

May 28, 1980 [GB] United Kingdom ..... 8017393
Jun. 25, 1980 [GB] United Kingdom ..... 8020811
Feb. 12, 1981 [GB] United Kingdom ..... 8104349

[51] Int. Cl.[3] ..... R65D 75/00

[52] U.S. Cl. ..... 206/175; 206/163; 206/170; 229/28 BC; 229/41 B; 229/DIG. 4

[58] Field of Search ..... 206/139, 141–143, 206/162–166, 170–191, 193, 198, 427; 229/28 BC, 52 BC, DIG. 4, 41 R, 41 B, 15, 27, 37 R

[56] References Cited

U.S. PATENT DOCUMENTS

| | | | |
|---|---|---|---|
| 2,558,918 | 7/1951 | Zinn, Jr. | 229/DIG. 4 |
| 2,653,749 | 9/1953 | Milchin | 206/191 |
| 2,668,653 | 2/1954 | Arneson | 206/164 |
| 2,733,832 | 2/1956 | Newton | 206/180 |
| 2,808,177 | 10/1957 | Buttery | 206/175 |
| 2,821,328 | 1/1958 | Ramsay | 206/180 |
| 2,849,112 | 8/1958 | Forrer | 206/141 |
| 2,880,921 | 4/1959 | Persson | 229/41 B X |
| 3,122,300 | 2/1964 | Bombard | 229/DIG. 4 |
| 3,158,286 | 11/1964 | Phillips, Jr. | 206/180 |
| 3,195,797 | 7/1965 | Feo | 229/41 B X |
| 3,283,950 | 11/1966 | Bolding | 206/193 X |
| 3,331,530 | 7/1967 | Wood | 206/188 |
| 3,836,065 | 9/1974 | Hackenberg | 229/27 |
| 3,893,565 | 7/1975 | Rossi et al. | 206/191 |
| 3,952,941 | 4/1976 | Zimmerman | 229/41 B |
| 3,960,313 | 6/1976 | Sax et al. | 229/41 B |
| 4,219,147 | 8/1980 | Kohler | 229/27 |
| 4,312,446 | 1/1982 | Summers | 206/185 |

FOREIGN PATENT DOCUMENTS

| | | | |
|---|---|---|---|
| 1235799 | 3/1967 | Fed. Rep. of Germany | 229/32 |
| 660735 | 3/1964 | Italy | 206/175 |
| 345682 | 4/1931 | United Kingdom | 229/41 B |
| 731708 | 6/1955 | United Kingdom | 229/41 B |
| 871452 | 6/1961 | United Kingdom . | |
| 883150 | 11/1961 | United Kingdom | 229/27 |
| 930050 | 7/1963 | United Kingdom | 206/163 |
| 939648 | 10/1963 | United Kingdom | 206/163 |
| 1592081 | 7/1981 | United Kingdom | 229/41 B |

*Primary Examiner*—George E. Lowrance
*Assistant Examiner*—Gary E. Elkins

[57] ABSTRACT

The disclosure relates to cartons with separaters which, where the articles to be separated are deep, comprise a lower arrangement of separaters according to the invention in co-operation with a higher arrangement of separaters of known form and supported from a stiff central separater according to the invention. The lower and upper separaters erect automatically when the carton walls are moved from the flat condition to the rectangular condition, the lower ones are extensions of the known Crash-bottom style and arranged to interact together according to the invention to erect the separater forming extensions for separating two or more articles such as glass bottles. The invention includes joining the two separate similar opposing structures associated with the known Crash-bottom to effectively form one bottom member fixed at its four sides and the invention extends from the flat blank, through a process for folding and gluing the flat blank, to apparatus erecting the carton and effecting joining of the bottom structures ready for the commercial use of the carton.

24 Claims, 57 Drawing Figures

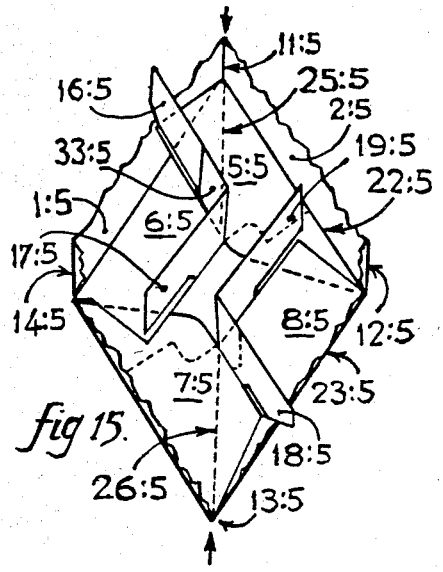
fig 15.
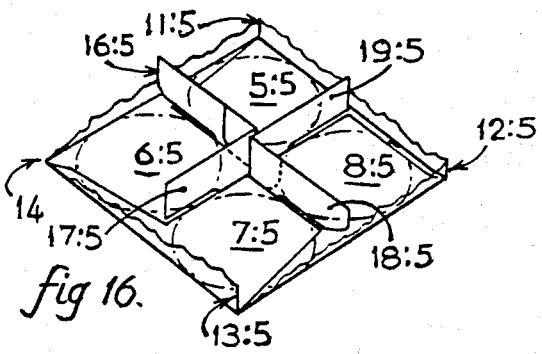
fig 16.
fig 50
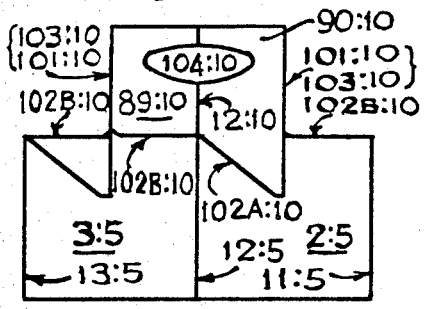
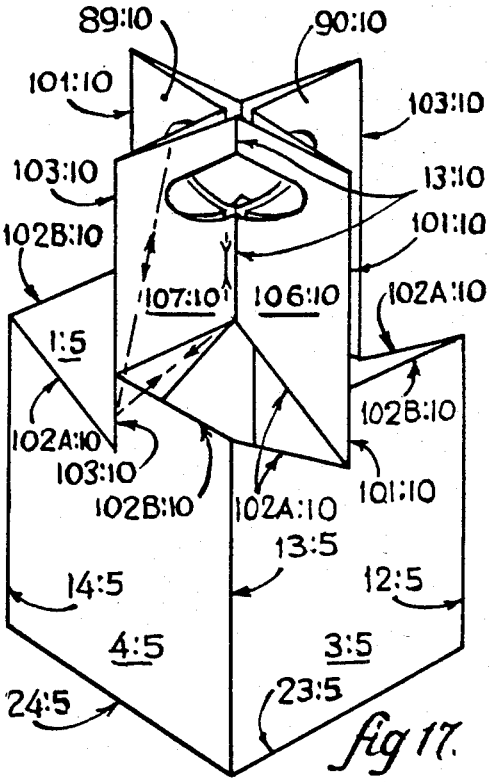
fig 17.

CARTON WITH SEPARATERS, ITS BLANK AND APPARATUS FACILITATING ITS ERECTION FOR USE

The present invention relates to cartons and providing the bottom of such cartons with substantially vertical separaters which when used with a top structure according to the invention, will extend the separation and provide a handle for carrying the carton filled with articles for sale. The invention therefore provides the blank for the carbon and means for its erection for use. One such use would be as a carrier for bottles.

Hitherto, for instance, carrier blanks have been made for glass bottles for which transport requirements make it necessary to have separation between the glass and these requirements have resulted in cartons with separaters between a central wall and two long side walls which, due to their method for folding flat when empty, have a bottom which is fixed to only the two long sidewalls. Such designs vary but they are necessarily complicated and require a lot of the paperboard from which they are made to be cut to waste, also the blank is complicated to fold and glue together which generally causes its production to be slow and limited to special gluing machines such as rightangle gluers so it is an expensive carton. Therefore it is desirable to be able to make such carrier cartons, or any carton requiring separaters or dividers, by using the type of bottom which will erect automatically when the sides are opened and are known generically by such names as the Crash-bottom, the Auto-bottom and the lock-bottom but such bottoms are weak and the reference to locking relates only to the engagement of two opposite parts of the bottom to prevent it returning to its original flat carton state. Furthermore such bottoms do not economically lend themselves to the provision of separaters, nor do they economically allow the type of flat folding required to allow a top structure, or one which can have a central handle held stiff as required by bottle carriers.

BRIEF SUMMARY OF THE INVENTION

It is an object of the present invention to provide a bottom which is self erecting and has separaters which are self erecting when the side walls are opened from the flat condition by means provided or locked by means provided and which will also erect a top structure of the invention when used as a carrier for bottles.

Accordingly the present invention provides a carton for use as an article carrier constructed and erected from a blank of sheet material including at least one upper separater panel member with a carrying opening and a bottom comprising bottom member panels depending from the bottom edge of each of four side walls at a horizontal line of fold, each side wall hinged by a line of vertical corner fold to a next side wall and when the carton is folded into flat condition two of the four said vertical corner folds lie between the two other vertical corner folds which are folded fully each with members adjacent to it forming two similar opposing structures, the adjacent bottom members folded to lie against the inside of the adjacent side walls and a glue lap divided from one of the bottom members of each structure by a diagonal fold meeting with the vertical fold folded fully and the horizontal line of fold, the glue lap folded to lie against the adjacent bottom member and glued to it; characterised in that opposing side wall parts of the erected carton have at least one substantially horizontal cut situated between substantially the top of the carton and the top of the carton walls of their full width, the ends of the cut connecting with the lower ends of two vertical folds which include a corner fold edge part of the carton therebetween and below the cut, a further vertical fold situated between the two vertical folds and above the cut, the carton material between the said two vertical folds reversing inwardly and situated to contribute stiffness to the carrying opening, said two vertical folds forming therefore additional such said corner fold edge parts of the carton. Such upper separation can therefore provide separation at the shoulders of bottles.

Such said stiffening is increased wherein at least one said corner fold is a corner fold, which is folded fully when the flat blank is folded and glued into a collapsed carrier ready for erecting into a carton, and has at least one said further vertical fold also folded fully and the carton material between the said two vertical folds reversing inwardly upon folding and gluing the flat blank into a collapsed carrier.

A further feature of the invention provides for its use as an article carrier for articles which require separation at the bottom such as the heel of a bottle and which separation can co-operate with separation at the shoulder to more economically provide separation effectively therefore for the article where it is straight sided from shoulder to heel.

Accordingly the invention provides a carton constructed from a blank including low separater means for separating its contents and having a bottom comprising bottom member panels depending from the bottom edges of each of four side walls by a horizontal line of fold, each side wall hinged by a line of vertical corner fold to the next side wall, and when the carton is folded into a flat assembled condition two of the four said vertical corner folds lie between the two other vertical corner folds which are folded fully each with members adjacent to it forming two similar opposing structures, the adjacent bottom members folded to lie against the inside of the adjacent side walls and a glue lap divided from one of the bottom members by a diagonal fold meeting with the vertical corner fold folded fully and the horizontal lines of fold, the glue lap folded to lie against the adjacent bottom member and glued to it; characterised in that the free edge of at least one bottom member of each one of said similar opposing structures carriers a separater forming extension hinging with a bottom member at a line of weakness dimensioned to communicate with a line of weakness hinging such separater extension of the similar opposing structure when erected and said separaters arranged and adapted for the transmission to them of opposition force from an engaging separater for their rightangular displacement relative to their said at least one bottom member when it is rightangularly displaced by its diagonal fold being angularly displaced vertically and horizontally, when the said horizontal lines of fold of the bottom members are rightangularly displaced and the sidewalls are rightangularly displaced and each fold for folding fully is opened and moved one toward the other.

Where two articles are separated by one separater wall it is sufficient for two separater extensions of two bottom panels to interact by one opposing the other to form one separater wall when erected but where there are four or more articles to be separated then such interaction is by one adjacent separater opposing another adjacent separater so the same opposition force is used but it is applied angularly and at the same line of contact as the angle increases and which line can therefore conveniently have a hinging line of fold located thereon and such hinge forms a further part of the invention.

The bottom is strengthened by the separaters which provide stiffness and its security is improved in that a separater part or a bottom member part or an extension of a bottom member part of one said similar opposing structure is secured to a separater part or a bottom member part or an extension of a bottom member part of the other similar opposing structure by a stitch of any material from one said part through the other said part.

The present invention extends from the flat and the glued blank for the carton so it also includes the process which cannot be carried out by hand for forming the carton for its use but only when used for erecting the carton according to the present invention and preparing it for commercial use by engaging and moving one side wall relative to another sidewall thereby opening each similar opposing structure and causing the relative adjacent bottom member panels joined by the said diagonal fold to draw apart and open the diagonal fold with the bottom members substantially flat between similar opposing structure side walls and cause the separaters depending from the bottom member panels to interact together and be supported at rightangles to the bottom. Apparatus means may be used for entering the carton and providing support for a part or parts of the inside of the bottom or separater to enable a locking action to be performed or a stitch action to be performed between the said similar opposing structures using paperboard or another material or any means for joining one similar opposing structure to the other.

The present invention also extends to the process for folding and gluing the flat blank according to the present invention into the folded and glued flat blank according to the invention including the stages for folding the bottom folds for the flat folded and glued blank, imprinting glue on the surfaces to be fixed, folding over the vertical lines of fold for folding fully and inwardly folding any carton material reversing inwardly between vertical lines of fold for folding fully, applying pressure while the glue fixes the carton and separater parts.

BRIEF DESCRIPTION OF THE DRAWINGS

Embodiments of the invention will now be described by way of example, reference being made to the accompanying drawings in which:

FIG. 15 shows the lower separation of the blank of FIG. 14 being erected.

FIG. 16 shows the blank of FIG. 15 erected.

FIG. 17 shows the blank of FIG. 16 with a suitable erected upper separation complete.

FIG. 50 shows the flat folded and glued blank before erecting as FIG. 17.

FIG. 108 shows a flat blank for folding and gluing as FIG. 46.

DETAILED DESCRIPTION OF THE INVENTION

Figure 1:
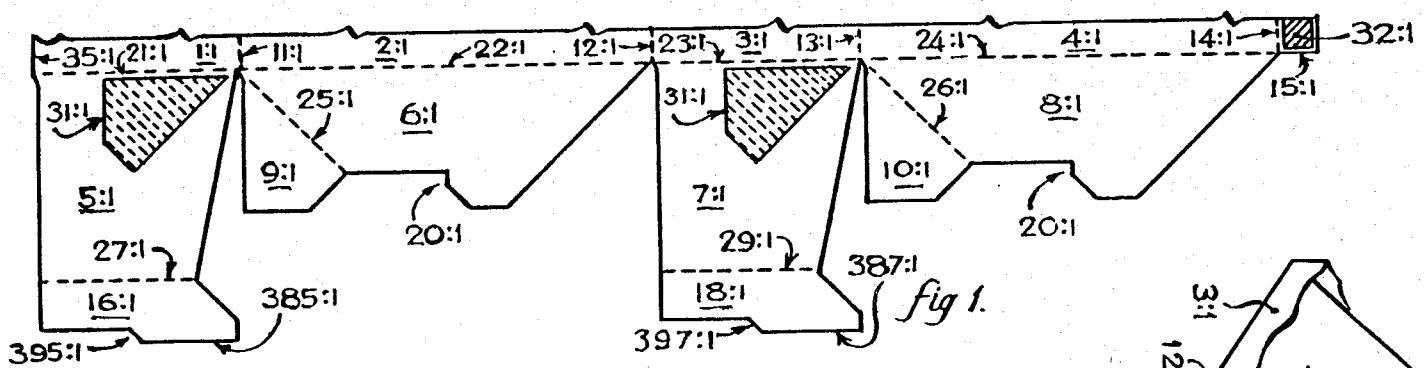
FIG. 1 shows a flat blank lower part providing a single lower separater

Separaters, or dividers as they are sometimes called, normally have to be added to the carton after it is made and erected and these vary from display cartons for sachets which require separation to prevent the sachets sliding about the floor of the carton, to carriers for articles such as glass bottles to prevent them abrading each other or breaking, in which case the separation could be as deep as the bottle body. However it is not necessary, in the case of most bottles for the separaters to be full depth of the bottle body because it is unnecessary and undesirable to have any separater between the bottle shoulder and the bottle heel, otherwise the bottle label can be scuffed and damaged. Therefore one of the most economic and advantageous uses of the present invention is as a bottle carrier and, although it is not the only use for the invention and the features of it, bottle carriers will be used as the example known to the inventor with some of its embodiments which include upper and lower separation although each could be used alone and some forms of lower separation can be used with upper separation other than that upper separation with which they are shown by way of example. Unlike the known added separation, the lower separation of the invention begins at and is integral with, the bottom of the carton. An advantage of the upper separation is that it uses only the amount of material required to surround the group of bottles on their four sides. In the drawings of flat blanks continuous lines show lines of cut and broken lines show lines of fold. The lower part of the invention begins with a bottom which automatically erects similar to the embodiment shown by FIG. 1 which shows the inside of the carton material.

Figure 10:
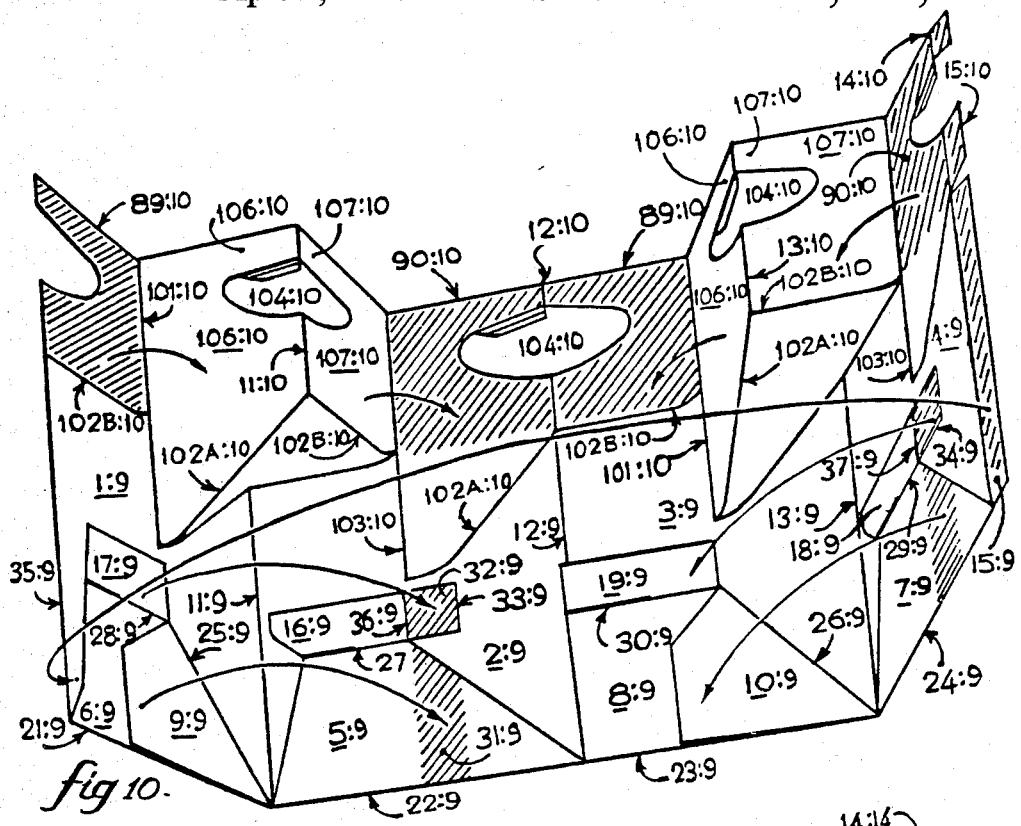
FIG. 10 demonstrates the gluing and folding of a complete carton with the lower. separation shown by FIG. 9.
Figure 13:
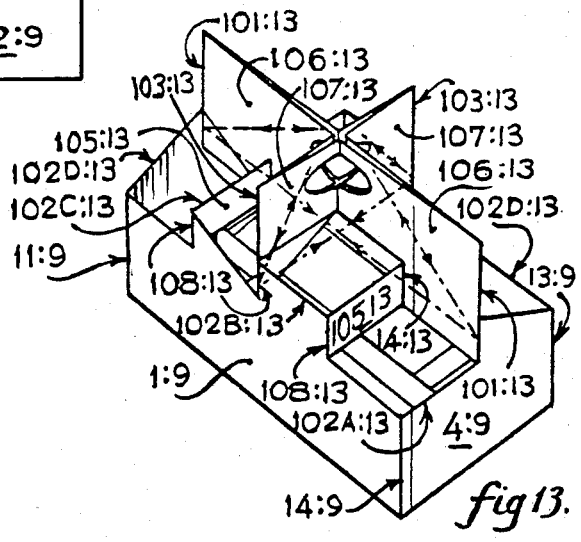
FIG. 13 shows the blank of FIG. 12 with a suitable erected upper separation complete.

The first number of each reference used indicates the part and the suffix after the colon, thus :, indicates the figure wherein the part is featured in detail. For instance in FIG. 17 reference 24:5 is the line of horizontal fold of the bottom featured in FIG. 5, and in the same FIG. 17 the reference 107:10 is seen in FIG. 10 and while the same number 107 is seen in FIG. 13 it is shown as 107:13 because it is differently disposed therein. Likewise FIG. 13 has bottom related parts with similar references and the suffix 9 because such features are interchangeable.

FIG. 1 shows two diagonal folds 25:1 and 26:1 which divide the glue laps 9:1 and 10:1 from the bottom member panels 6:1 and 8:1 which are folded up at a horizontal line of fold 22:1 and 24:1 respectively to lie against the inside of side walls 2:1 and 4:1 respectively as the glue laps 9:1 and 10:1 are folded back to overlie bottom members 6:1 and 8:1. The bottom members 5:1 and 7:1 are folded up to lie against the inside of side walls 1:1 and 3:1 respectively, so that the glue laps 9:1 and 10:1 can have glue applied to them and will fix to areas 31:1, which are shown by broken lines of shade because they are on the reverse of the carton material as shown, when side walls 1:1 and 4:1 are folded fully at lines of fold 11:1 and 13:1 to overlie side walls 2:1 and 3:1 respectively to form two similar opposing structures when glue lap 15:1 is glued and fixed to free side wall edge 35:1. This embodiment of the invention is erected by moving the side walls such that vertical fold 11:1 and vertical fold 13:1 move one toward the other their bottom member panels of their own opposing structure being 5:1 adjacent 6:1 and 7:1 adjacent 8:1, will each be drawn down to form a common floor of the carton and the two edges 20:1 will oppose each other and be pushed one past the other and lock the bottom into place after so passing which prevents the return of the bottom folds to their collapsed flat form. During the action of erecting the carton bottom according to FIG. 1 the bottom members 5:1 and 7:1, being angled one toward the other, cause the members 16:1 and 18:1 to be also angled one toward the other.

Figure 2:
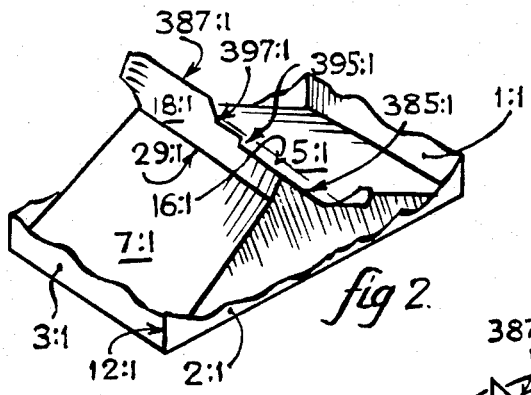
FIG. 2 shows the lower blank part of FIG. 1 being erected.
Figure 3:
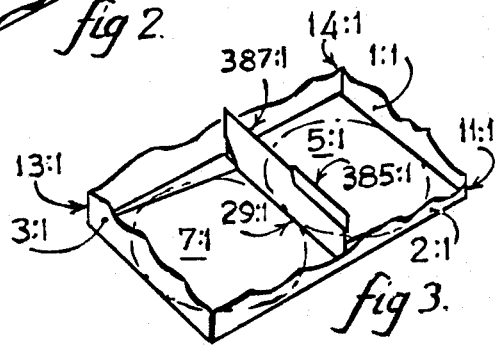
FIG. 3 shows the lower blank part of FIG. 1 erected.

FIG. 2 shows the greater depth 385:1 of separater 16:1 overlapping therefore the shallower depth 397:1 of separater 18:1 and the greater depth 387:1 of separater 18:1 overlapping the shallower depth 395:1 of separater 16:1 such that as they slide across each other the separaters 16:1 and 18:1 so engaged will push equally one against the other without one slipping over the other and so will erect each other with one opposed to the other by its resistance to bending at their lines of weakness 27:1 and 29:1 respectively which will maintain them perpendicular to the bottom of the carton, FIG. 3. Therefore the force that is responsible for erecting them is the opposing force resulting from the change of angle of the bottom members. The separater embodiment of FIG. 1 is in its simplest form and it is required where only two articles are to be separated with only one separater between and the arrangement is useful for separating such items as whisky bottles, especially as the separation is therefore equal to two thicknesses of carton material. It will be seen later that by employing an arrangement related to that shown by FIGS. 6 and 7 two more opposing separaters can be arranged in the other direction as when fixed to panels 6:5 and 8:5 being separaters 17:5 and 19:5 respectively of FIG. 5. Reference figures throughout this description are related in that similar figures have related purpose but they differ in their suffix. The suffix relates to the figure number which shows such difference best, such difference is not necessarily a species but it is one form of one species Therefore FIGS. 1, 2 and 3 include reference figures which all include the suffix 1 from FIG. 1 but the FIGS. 54 and 4 have the suffix 4 because they include the upper separation which is best recognized by considering the FIG. 4.

Figure 54:
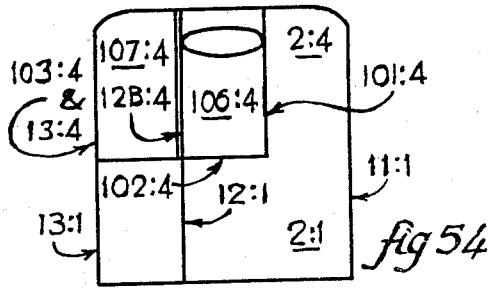
FIG. 54 shows the flat folded and glued blank before erecting as FIG. 4.
Figure 4:
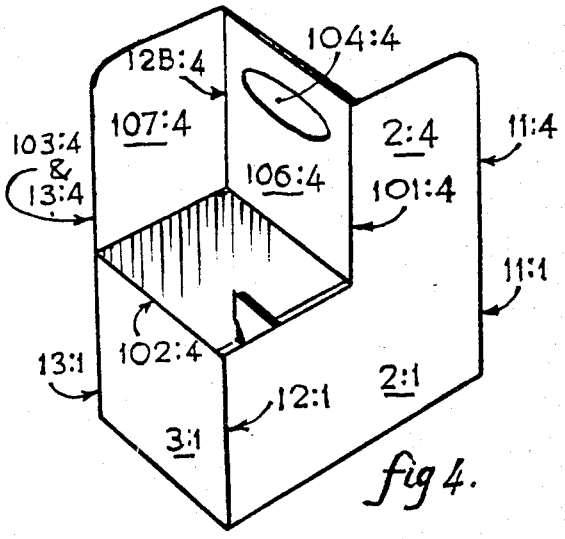
FIG. 4 shows the blank of FIG. 3 completed with a suitable upper separation.
Figure 55:
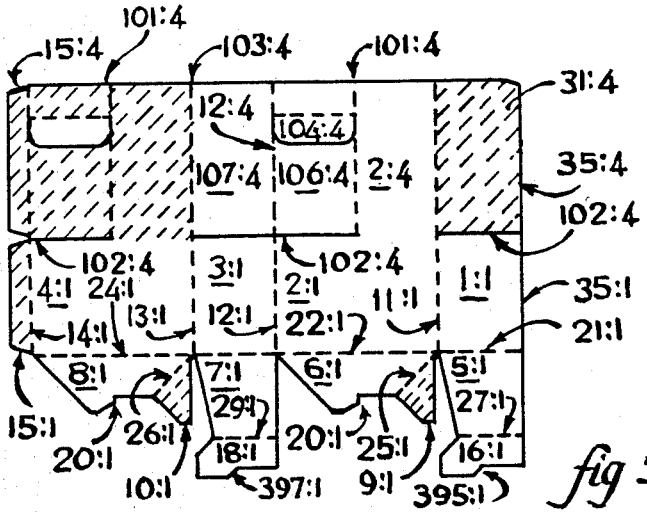
FIG. 55 shows a flat blank for folding and gluing as FIG. 54.

FIG. 54 shows the lower separation included into a suitable upper separater structure wherein the corner fold edge part 12:1 has a cut 102:4 situated above the full width parts of the side walls 2:1 and 3:1, which cut runs from the lower end of vertical fold 101:4 and the lower end of vertical fold 103:4 and which in some species, such as this one, also coincides with the upper fold 13 being 13:4. Between the vertical folds 101:4 and 103:4 there is a further vertical fold 12B:4 which is a reverse fold allowing the carton material between the folds 101:4 and 12B:4 being 106:4 and between folds 12B:4 and 103:4 being 107:4, to reverse inwardly and to contribute stiffness to the carrying opening 104:4 as shown by FIG. 4 wherein the carton carrier of FIG. 54 is seen erected ready for use. FIG. 4 also shows that the carrier is seen to be the same whether corner fold edge part 12:1 is in the forefront or corner fold edge part 14:1 (hidden but seen in FIG. 3) is in the forefront because the carrier is equi-formed on each side of the one upper separater panel 106:4 combined with the other separater panel 106:4 The flat blank, where the lower separation shown by FIG. 1 and the upper separation shown by FIG. 4 are combined, is shown by FIG. 55 as seen from the outer side and all references therein have the meaning as discussed previously, with suffixes 1 and 4. The blanks in flat condition are shown together so that they may be readily compared and the scope and opportunity offered and taught by the description can be more readily learned. Shaded areas using broken lines are adhesive. The reverse fold 12B:4 and related to 12:1 would normally be given the reference "A" but because it is relatively long and there is a fold 101:4 behind it which resists expansion, while a normal reverse fold will resist compression, making the total fold very resistant because they are folded while back to back in this way. The inside fold is a reverse fold and may be formed by prepressing the paperboard in two parallel lines separated by between eight and sixteen times the thickness of the board and made by a strip of hard material between the parallel lines when pressed so that the paperboard between is raised in height by more than the thickness of the paperboard material and remains so in the assembled blank. When the assembled blank material so prepared and placed on a line of normal fold of the backing material are folded while together, the inside material must contract and the surplus material is relieved by the raised material rising further and allowing the total folding to take place without undue resistance, in FIG. 4 and in other figures where shown.

Figure 5:
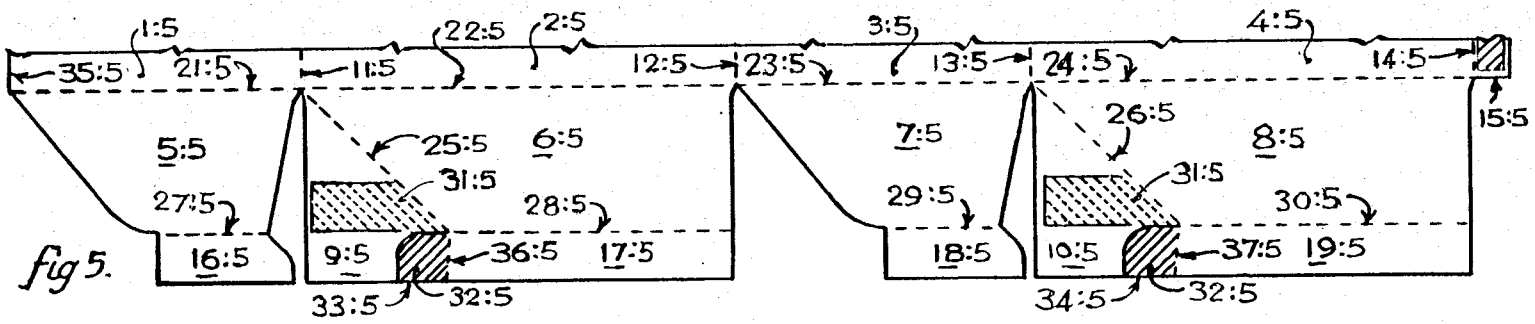
FIG. 5 shows a flat blank lower part using related glue laps.

The container carrier described above has good commercial value but it is a simple form of the invention relative to other embodiments and it will be understood that the opposition force, responsive for displacing and erecting the separaters, is the same force when the resulting erected separaters are adjacent one to the other, because they begin by facing each other and are to some degree facing each other throughout their angular displacement until they are rightangular one to the other as will be shown by the example of FIG. 5 separation.

FIG. 5 shows the outside of a blank for lower separation for a carton bottom according to the invention wherein the separaters 16:5 and 17:5 will oppose each other when bottom members 5:5 and 6:5 are folded to overlie side walls 1:5 and 2:5 and will be connected by glue lap 9:5 divided from bottom member panel 6:5 and folded to overlie 6:5 and adhesive is applied to it at area 31:5 and adhesive is applied 32:5 to glue lap 33:5, and the fold 11:5 is folded fully for the adhesive therebetween to fix the contacting surfaces to form a structure which is opened by rightangularly displacing the side walls 1:5 and 2:5. The separaters 18:5 and 19:5, the bottom members 7:5 and 8:5, the glue lap 10:5 and the glue lap 34:5 similarly treated to form a similar opposing structure attached to the first similar opposing structure by line of fold 12:5 and 14:5 when the glue lap 15:5 is fixed by an application of adhesive to free edge 35:5.

Figure 6:
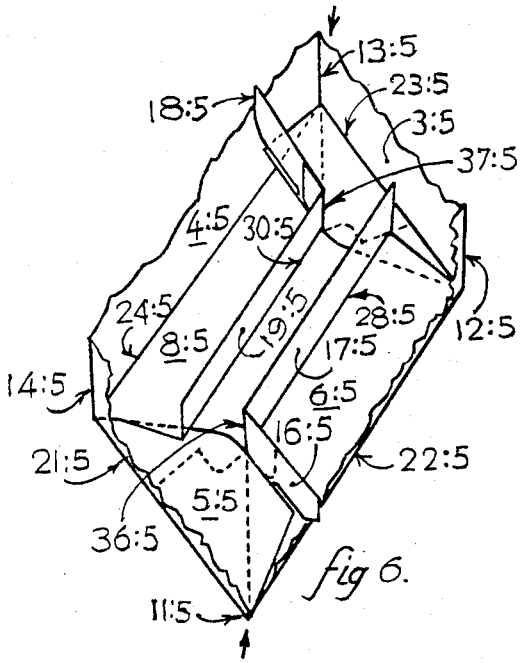
FIG. 6 shows the blank of FIG. 5 glued together and being erected.
Figure 7:
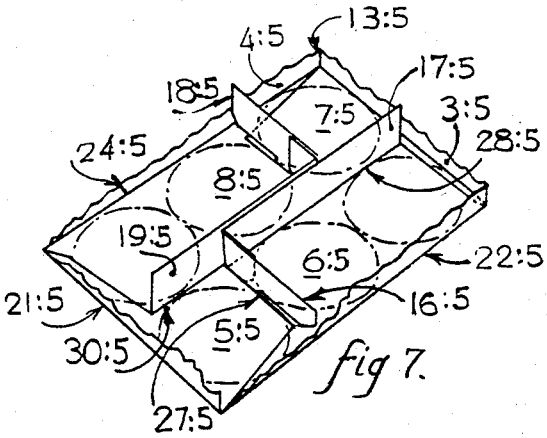
FIG. 7 shows the blank of FIG. 6 erected.

The theory of the action in each similar opposing structure is that upon rightangularly displacing the side walls adjacent the line of corner fold for folding fully, the edge 36:5 will rest against and continuously oppose the separater 16:5 as they are each similarly angularly displaced until they are rightangularly displaced, whereupon the edge 36:5 would no longer oppose separater 16:5 and would slip forward abruptly due to the resilience of its hinging line of weakness 28:5 along with line of weakness 27:5 but for the fact that the line 36:5 is also a line of hinge, hinging glue lap 33:5 which is fixed to separater 16:5, so preserving the erect position of the separaters and aiding their efficiency throughout the displacement as shown by FIG. 6 until they are erected as shown by FIG. 7.

FIG. 6 shows that if there was no hinge 36:5 the above may not happen but that is only because the edge 36:5 is so close to the adjacent edge of separater 16:5 that in practice it would slip off, whereas if the separater 16:5 was continued as in FIG. 18 or 22, described later, then 16:5 and 17:5 would remain together just as 16:18 and 17:18. However such slipping off is a practical consideration and so is the hinge and the theory of the erecting force is unchanged, whether the opposing force for displacing the separaters at rightangles to the bottom is by direct opposition as in FIG. 2, or angular opposition as in FIG. 6, and which is made efficient in practice by the presence of the hinge 36:5.

Figure 14:
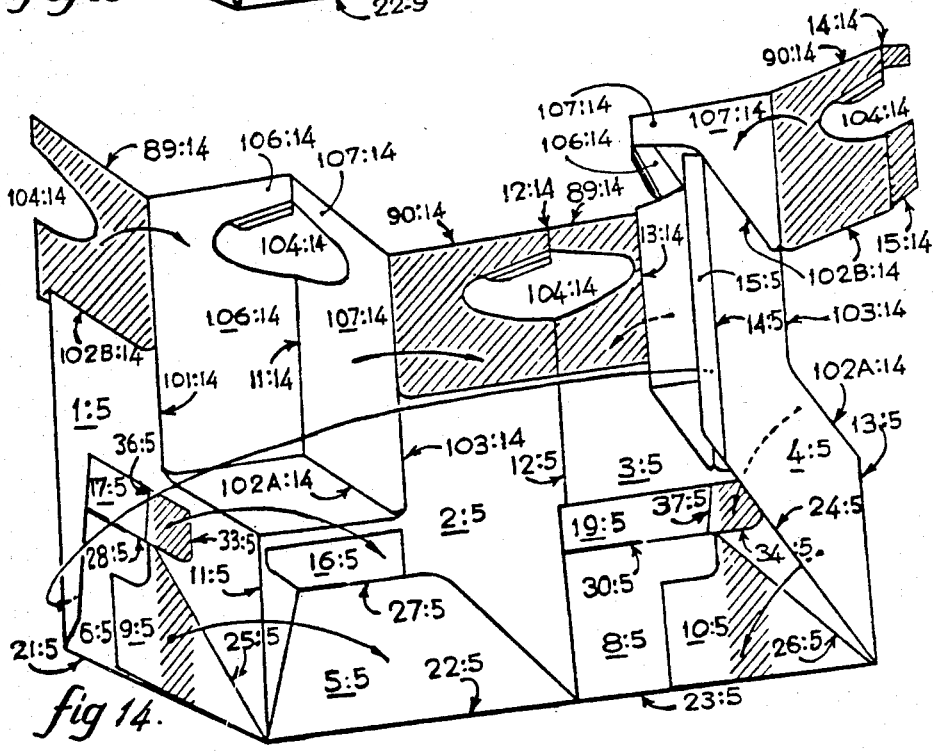
FIG. 14 demonstrates the gluing and folding of a complete carton using related glue laps.

FIG. 7 shows the lines of weakness 28:5 and 27:5 meeting and 29:5 (hidden) and 30:5 meeting after the separaters 18:5 and 19:5 connected at edge 37:5 all of the similar opposing structure have also erected in the same way, for six containers, although it could be adapted to say four as at FIG. 14, or for eight containers as at FIG. 13.

Figure 52:
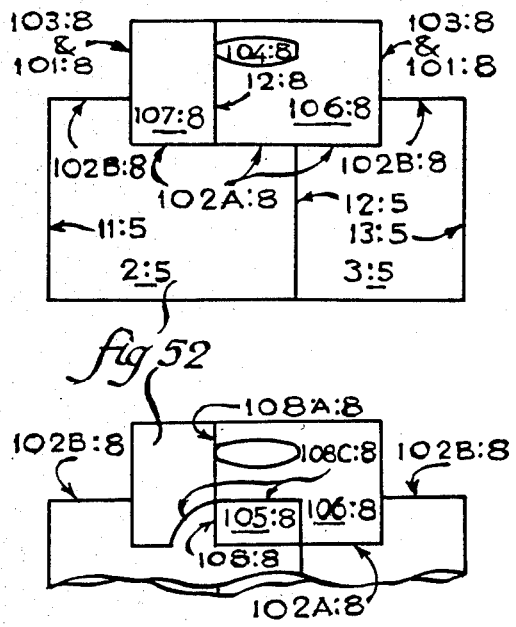
FIG. 52 shows the flat folded and glued blank before erecting as FIG. 8.

FIG. 52 shows such a carton for six containers with a suitable upper structure in two variations in the assembled flat folded and glued condition.

Figure 8:
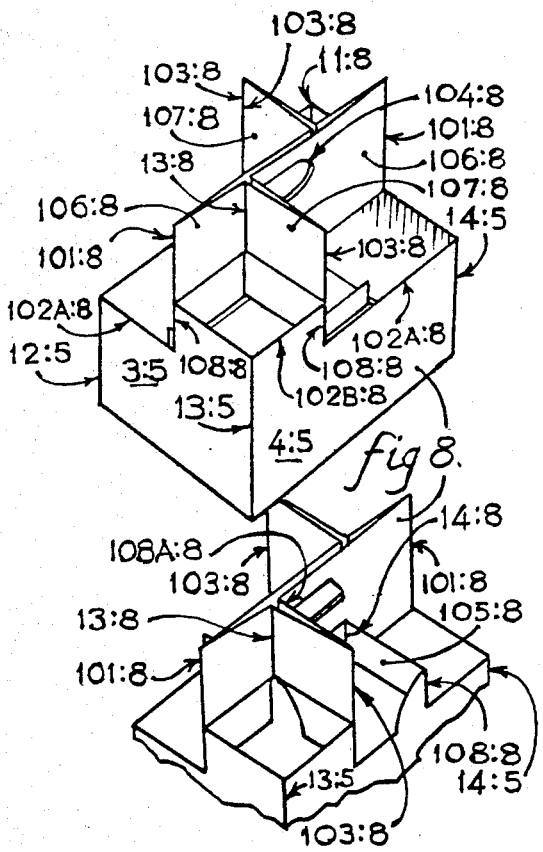
FIG. 8 shows the blank of FIG. 7 with two suitable upper separations, erected.

FIG. 8 shows the same assembled carton upper structure as FIG. 52 but in the erected condition.

Figure 56:
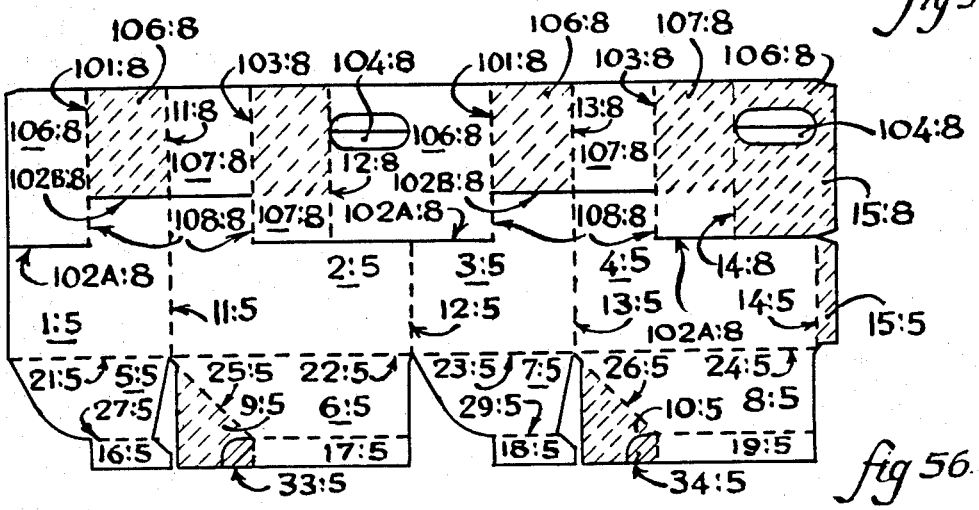
FIG. 56 shows a flat blank for folding and gluing as FIG. 52.

FIG. 56 shows a flat blank for such a carton as the upper one in FIG. 52 and 8. Whereas the flat blank shown by FIG. 55 was merely glued where shown shaded by broken line, being on the inside, and finally folded at the folds 13:1 and 11:1 as described for the bottom, FIG. 56 is slightly more complicated in that after folding, the bottom members 5:5, 6:5, 7:5, 8:5 at horizontal lines of fold 21:5, 22:5, 23:5, 24:5 to lie against the inside, the glue laps 9:5 and 10:5 back to overlie the bottom member and adhesive is applied to the shaded areas, or to the area with which it will make final contact and the blank is finally folded at the lines of fold for folding fully 11:5/11:8 and 13:5/13:8, the folds 11:8 and 13:8 are raised and as the final fold is made for 15:5/15:8 to fix to 1:5 and 106:8, the folds 11:8 and 13:8 with their co-operating lines of vertical fold 101:8 and 103:8 will all be folded fully. The carton is discussed in more detail.

In practice its performance does not have as much value as the others, mainly because it is unbalanced about the finger hole 104:8 which is not supported equally on each side by the material for supporting it, however it does serve to demonstrate a link in the upper structure of the invention because it will be seen that, relative to FIG. 4 the upper structure, as well as the lower structure have the width extended by a pair of related compartments on each side of it so that it is now the length of six compartments with the lower separation 17:5 and 19:5 in direct opposition as 16:1 and 18:1 in FIG. 2, but the at least one separater 106:4 is made to be continuous in 106:8 simply by repeating the invention. Refering again to the further lines of fold 11:8 and 13:8 which are fully folded, this is done to take material from the outside of the carton's upper structure where is can do no good and to move it inward to contribute stiffness to the carrying opening and it is made possible by having another substantially horizontal cut 102B:8 below each of the further vertical folds 11:8 and 13:8 and above the lower part of the at least one separater 106:8.

Such higher substantially horizontal cutting as 102B:8 will join two vertical folds 101:8 and 103:8. Such inwardly reversing carton material at the point of gluing is important because it is glued to make two glued double thicknesses. This introduces an important difference in the same invention because as it is so repeated above the vertical corner fold which is folded fully in the assembled flat blank, the further fold 13:8 and 11:8 are together and in line so forming a handle support which is four thicknesses of carton material thick along two thirds of its length across the top of the carton and which if used in such condition would provide the necessary balance about the finger hole 104:8. Similarly FIG. 50 shows the assembled blank with such stiffening across the full width of the carton upper structure.

In FIG. 8 the panels are shown to be made up of two thicknesses by leaving a gap for a better understanding however it will be understood that they are able to be glued together where required to ensure that they open from the flat condition where they are required to do so. It is notable that gluing machines in use prior to this invention were not considered adaptable for causing carton material to be inwardly reversed in their final fold stage since it is a new requirement.

The lower part of FIGS. 52 and 8 show a part view of a carton where the lower parts, 105:8 of the upper separation is divided from the remainder of the said at least one upper separater and known as a strap and as such it is not able to significantly contribute to the stiffness of the handle.

Figure 9:
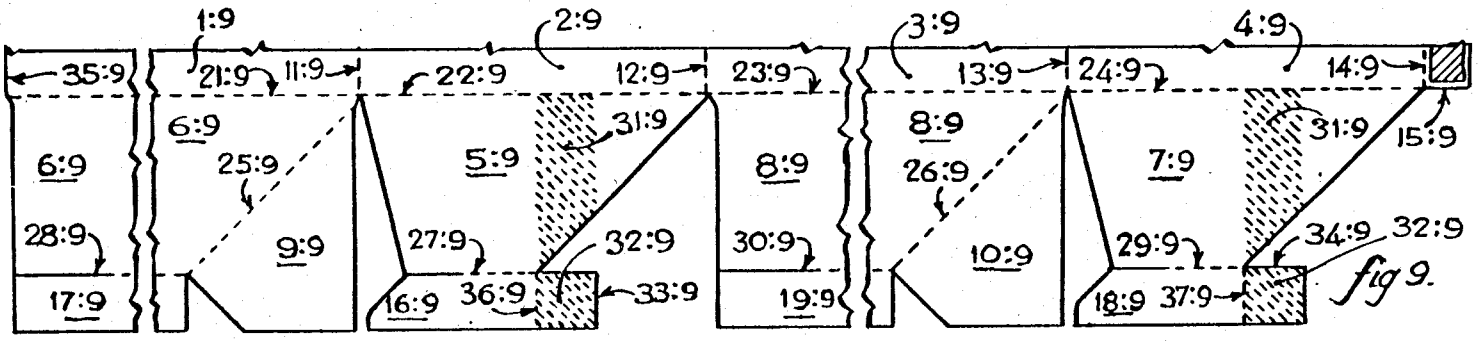
FIG. 9 shows a flat blank lower part using disassociated glue laps.

FIG. 9 shows the inside of a blank for a carton with lower separation and which is a variation on that described for FIG. 5. The edge and hinge line 36:9 and 37:9, along with their glue laps 33:9 and 34:9 respectively replace glue laps 33:5 and 34:5 in the same second side wall 2:9 and third fourth side wall 4:9 related positions and other panels have been moved therefore as appropriate. Also the area of adhesive application 32:9 to glue laps 33:9 and 34:9 are shown shaded in broken line because the inside of the carton material is shown and the area of adhesive application 31:9 for joining with diagonal glue laps 9:9 and 10:9 is shown instead on bottom members 5:9 and 7:9 respectively to illustrate such alternative position of the adhesive area because it will be understood that the adhesive application is made to which ever of the surfaces for fixing is most convenient in the process for the gluing machine. Such adhesive in the instance of carriers for bottles such as basket carriers is a wet-strength adhesive such as P.V.A. In FIG. 5 the glue laps 33:5 and 34:5 were made from material which is a part of diagonal glue laps 9:5 and 10:5 and so they are associated with them. However they can be disassociated as in FIG. 9 by moving them to separater 16:9 and 18:9 and which are dependent from the free edge of bottom members 5:9 and 7:9 at horizontal hinge lines 22:9 and 24:9. The diagonal glue laps 9:9 and 10:9 are divided from bottom member panels 6:9 and 8:9, and from their free edges, hinged by lines of weakness 28:9 and 30:9, are separaters 17:9 and 19:9, while the bottom member panels 6:9 and 8:9 depend from side walls 1:9 and 3:9 at lines of horizontal fold 21:9 and 23:9 respectively and these first and third positions are shown with a line of break because they could be any suitable length. For instance they could be the length for eight containers as shown by FIGS. 11, 12, 53 and 13. FIG. 12 shows circles of chain line denoting the positions of containers being separated all the length of the bottom centrally to divide the width but only one separater on each side of it to divide an end container from the remainder. Therefore the invention provides stiffness and separation for the bottom but two extra separaters are required at the bottom one each side which can be supplied by other means and still be more economic. However where the blank of FIG. 9 is used for only four containers they are all separated at the bottom as shown by FIG. 10, with walls of equal width. FIG. 10 shows a carton for four containers with separation at the top and bottom. Adhesive 31:9 and 32:9 is shown added to bottom panel member 5:9 and 7:9 and to separater glue lap 33:9 and 34:9 respectively but as stated when describing FIG. 9 it could equally be added to the co-operating surface, as it has been in FIG. 14, and although no account of it has been considered in the drawings, such adhesive applications are normally arranged so that the centre of the carton is clear of adhesive so that the drive belts can grip the carton in the gluing machine. Therefore adhesive areas are favoured on the infolding parts which are shown raised beyond the folds 11:9/11:10 and 13:9/13:10.

When describing FIGS. 52 and 8 it was shown that part of the carton material for reversing inwardly would be reversed at the time of gluing and in FIG. 10 the material is 106:10 and 107:10 divided by the further fold 11:10, and 106:10 and 107:10 divided by further fold 13:10. Therefore as shown the two centre panels 2:9 and 3:9 with their depending bottom member panels 5:9 and 8:9 and their separaters 16:9 and 19:9 with diagonal glue lap 10:9 folded to overlie 8:9, would be passed between the drive belts and whereas the drive belts are normally positioned to run as close to the final folds as possible, in this situation they would run close to the folds 103:10 and 101:10. The final folds are those defined as for folding fully, which is true of all erectable cartons in the final-fold section of the machine, however in this situation and all forms of the present invention where there is an infolding of carton material at the time of folding and gluing, as opposed to the present invention where there is an infolding of carbon material at the time of erecting the carton and depending only upon which corner of the carton is subject to the invention, the final folds 11:9/11:10 and 13:9/13:10 cannot be reached by the drive belts as in normal gluing machine practice but because it has not been done before no solution to the problem has been required. The solution according to the present invention therefore for folding the blank for gluing lies in the blank invention itself as follows and as described for FIG. 35. In paperboard, the fibres are bent locally and in a line required for folding by pressure from a creasing rule into a recess but it is a stiff line for folding and not free hinged until the fibres are loosened by prefolding by causing it to bend while held close to the line for folding, therefore the line of fold 11:9/11:10 and line of fold 13:9/13:10 are prefolded so that they will hinge more freely than other lines of fold when in the final fold section of the machine and because the carton material held there between the drive belts is double along the lengths of horizontal lines of fold folded fully 22:9 and 23:9 right up to final folding lines 11:9 and 13:9 and the carton material is again double thickness beyond them at horizontal lines of fold 21:9 and 24:9, the material will bend at 11:9 and 13:9 when fully folded folds 21:9 and 24:9 are raised and folded inwardly due to the concentration of stiffness up to, and then again beyond, 11:9 and 13:9. It is simultaneously, or only slightly later, necessary to raise the prebent reverse folds 11:10 and 13:10 so that they will move overcentre and thereafter reverse inwardly. In the case of a carrier for bottles the matter is helped by the carton material being a Carrier Board which is a white coated unbleached pure coniferous kraft paperboard which is very stiff and which hinges well. As shown at reference 76 of FIG. 35 the raising of folds 11:10 and 13:10 is done by a mechanical lifter but it is common practice to do such raising, or initiating of a movement, by a flat spring blade, fixed to press continuously but by a controlled amount, against the blank as it passes over so that the prefolds 11:10 and 13:10 will always be lifted at the right time without the need for timing the action. The long arrows on the drawing FIG. 10 show the positions to which the contacting areas will reach with an area of adhesive equal to that shown shaded therebetween in the assembled carton. It is therefore suited to a high speed in-line gluer. FIG. 10 is also noteable in demonstrating a further arrangement of the substantially horizontal cut 102A:10 which is one cut continuous with the substantially horizontal cut 102B:10 because by covering two or more different cut levels between vertical folds 101:10 and 103:10 without meeting with any similar line of cut it will produce the necessary attachment between the upper carton structure and the lower carton structure. This carton is shown erected at FIG. 17. FIG. 10 is grouped with FIG. 14 to enable comparisons to be made.

Figure 11:
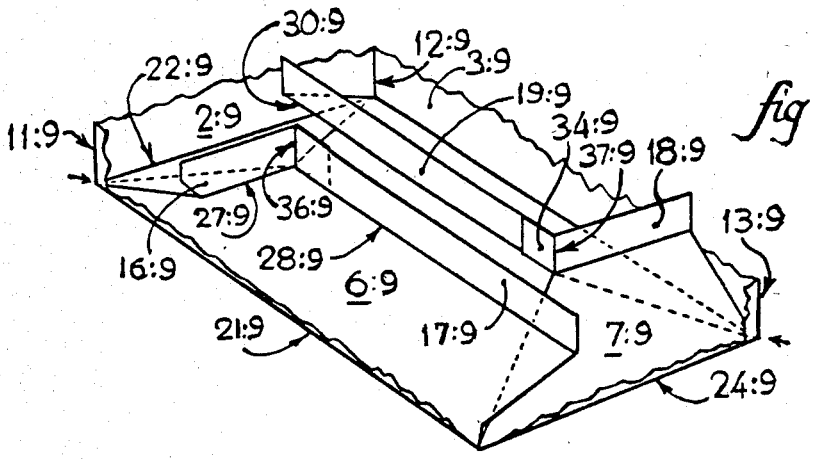
FIG. 11 shows an elongated version of the blank shown by FIG. 9 being erected.
Figure 12:
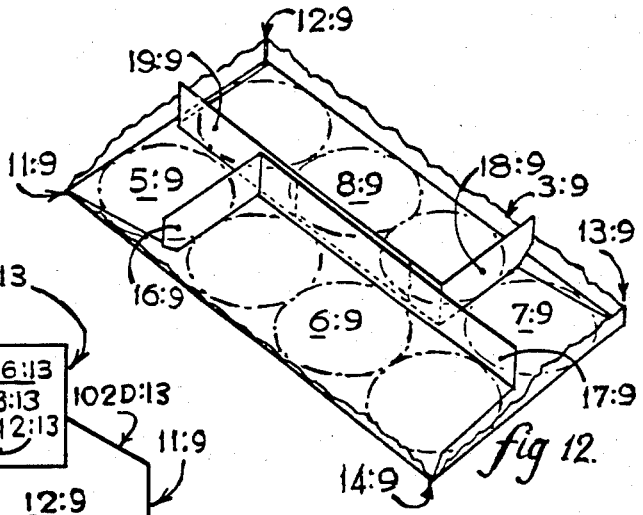
FIG. 12 shows the blank of FIG. 11 erected.
Figure 53:
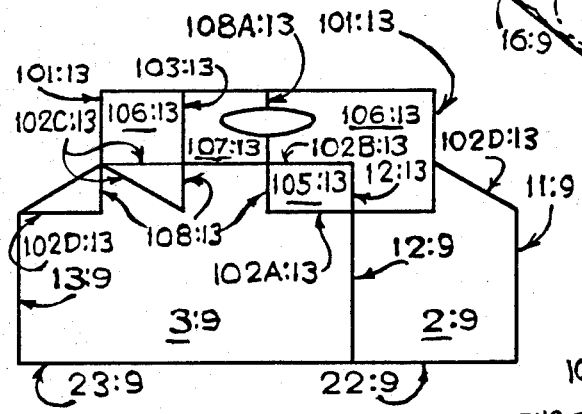
FIG. 53 shows the flat folded and glued blank before erecting as FIG. 13.

FIG. 11 shows the blank of FIG. 9 elongated as previously stated for eight containers but if considered having the sidewalls all of the same length as at FIG. 10 then separaters 18:9 and 16:9 would be moved to come opposite to effectively provide one separater from side to side to FIG. 12 and as shown like the FIGS. 15 and 16 which derrive from FIG. 14 so it will be understood that the blank of FIG. 5 could similarly be used for eight containers by elongating two walls. As seen FIG. 11 shows the separators 17:9 and 16:9 erecting each other by their opposition and angularly connected to receive such force by 36:9, while separaters 18:9 and 19:9 erect each other by their opposition and angularly connected to receive the opposing force by 37:9 until they are erect as seen in FIG. 12. FIG. 53 shows an assembled flat blank upper structure for a carton suitable for such eight containers and assembled from a blank according to the invention as shown by FIG. 57.

Figure 57:
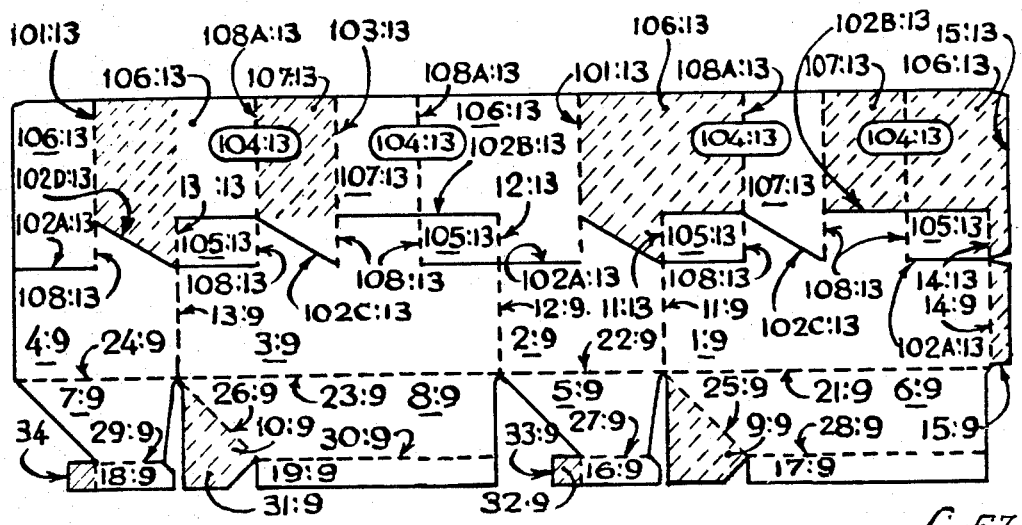
FIG. 57 shows a flat blank for folding and gluing as FIG. 53.

FIG. 57 shows a flat blank suitable for eight containers as seen from the outside therefore the glued areas are mostly on the reverse and therefore shown shaded by broken lines. The lower structure, being related to the blank of FIG. 9 for the sake of example only, has references all with the suffix 9. The upper structure being shown in the erected condition by FIG. 13 all have the suffix 13. The bottom member panels 7:9, 8:9, 5:9, 6:9 are all folded fully at the horizontal folds 24:9, 23:9, 22:9, 21:9 to lie against their respective side wall inner sides with diagonal glue laps 10:9 and 9:9 folded fully at diagonal folds 26:9 and 25:9 to overlie bottom panel members 8:9 and 6:9 respectively. Adhesive is applied to all of the areas shown shaded by broken lines or the areas that they are intended to contact when folded into the assembled flat blank. The blank is folded at the lines of fold for folding fully 13:9 and 11:9 and as they begin to overfold the sets of upper separation formed by carbon material 106:13 and 107:13 divided by further vertical fold 108A:13 and 106:13 and 105:13 divided in one set by fold line 13:13 and in the other set by fold line 11:13 each set of upper separaters being raised overcentre so that the dividing folds (otherwise refered to as further vertical lines of fold) 108A:13 and 13:13 and 11:13 will reverse fold and will become fully folded along with fold lines 101:13, 103:13 and 108:13 when fold lines 13:9 and 11:9 are fully folded and the glue lap 13:9/15:13 has fixed with the other free end of the blank.

A difference between the blank of FIG. 57 relative to the blanks of FIGS. 10 and 56 is that not all of the reverse folding is in a line with the other folds for folding fully 13:9 and 11:9 so there is no continuous fold line across the blank and so it is not possible to provide it with a simple prebend or subsequent fold in the final fold section of a gluing machine and so an in-line high speed gluer may not be suitable.

FIG. 13 shows the blank of FIG. 57 and assembled as FIG. 53 erected and it shows that carton material for reversing inwardly to contribute stiffness to the handle need not be reversed from above a vertical corner fold of the lower carton structure and it can be reversed from above any vertical corner fold of the carton, including a vertical corner fold of the carton which has resulted from reversing material inwardly above another vertical corner which may be a vertical corner of the lower carton structure and which has resulted in the carton of FIG. 13 not having a continuous fold line across its blank (FIG. 57) for prebending as mentioned above.

For instance all material length for reversing inwardly, according to the invention in every instance shown, is equal to a length of the periphery of the lower structure as seen in plan view excepting that is can be divided in its height as seen from side view so that such divided material is available to reverse again in plan view as demonstrated by the lower parts of FIGS. 52 and 8, and it will reverse as a rectangle or multiple of a rectangle with an inward corner opposite a outward corner above a substantially horizontal line of cutting connecting with the other two corners of the square. Consider the example of FIG. 13, even when the strap 105:13 is separated out, the material of upper separators 106:13 and 107:13 contribute stiffness to the carrying opening where they meet at a said further vertical fold 108A:13 opposite the vertical corner fold 108:13, which corners are divided by horizontal cutting 102B:13 and which vertical corner 108:13 is a corner resulting from carton material 105:13 and 106:13 reversing inwardly on each side of further vertical fold 14:13 above vertical corner fold 14:9 and divided from it by the substantially horizontal line of cut 102A:13 meeting with vertical folds 108:13 and 101:13. The horizontal cuts are refered to as being substantially horizontal because although they all afford the result as above, it is necessary for them to avoid meeting another of its kind in order to avoid severing the carton upper structure from its lower structure and which would defeat its object, so it must therefore change it height during its horizontal travel, in some instances, to reach a different level. For instance in FIG. 13 of the said substantially horizontal lines of cutting 102A:13 is horizontal, 102B:13 is horizontal, 102C:13 is substantially so, 102D:13 is substantially so and then they repeat. Therefore there may be different cuts on different levels. FIG. 13 further includes chain dot lines from the carrying opening and forming two triangles, one transverse to the other and showing the distribution of tension and compressive forces acting in the upper separation arrangement of this example with arrows pulling apart in the outer angles and showing tension and arrows pointing one toward the other in the horizontal lines showing compression.

Figure 44:
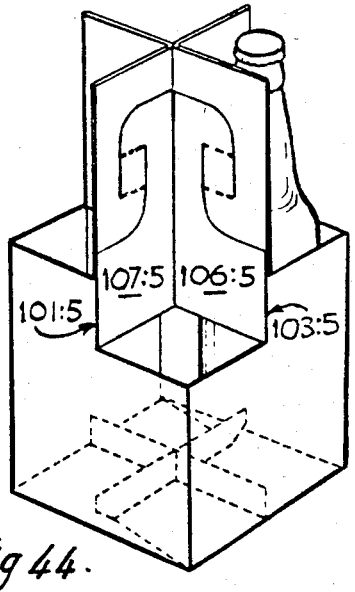
FIG. 44 shows the blank of FIG. 43 erected as for travelling with bottles inside.

Now in FIG. 13 the top edge of the carton's upper structure separation panel members, which are for fixing together as previously described, are shown a little apart to aid the understanding of their composition. However the result of the triangles of force distribution shows that when the carton is loaded with containers and supported by the carrying opening, the separation panels will pull apart in the way that they are shown apart in FIG. 13, therefore it will be realised that where the carton material is sufficiently stiff and the load is sufficiently light then it will suffice to draw the members together by hand and to hand glue the separator panel members at their central meeting point local to the inner sides of the cross to make the invention servicable. In this way it is only necessary to glue the carton lower structure including the glue laps 15:9 and 15:13 in the gluing machine and which can be a high speed in-line gluer. FIG. 14, like FIG. 10, shows a blank with adhesive applied to it being folded for assembly and here the bottom is the blank shown by FIG. 5, so it makes the point that any suitable lower structure may be used with any suitable upper structure separation. It also shows the carton material 106:14 and 107:14 reversed inwardly all as in FIG. 10 and previously described although such references here have the suffix changed to 14 because it typifies the variation wherein the substantially horizontal cut 102A:10/102B:10, since it included two levels of height, is replaced by the horizontal cuts 102A:14 at the lowest level of upper separation required and 102B:14 which is above the beginning of the upper separation. A similar carton to that of FIG. 14 is shown by FIG. 44 erected and it will be realised that the result is the same whether cut 102A:14 being the low cut is across panel 106:14 and 107:14 or across panels 90:14 and 90:14, or a cut 102B:14 is across panels 90:14 and 89:14 or across panels 106:14 and 107:14 or across a corner 101:14 resulting from the infolding or across a corner 103:14 resulting from the infolding as seen in FIG. 13, in fact it is easier to infold where the reverse fold 11:14 and 13:14 is as short as possible so it would be advantageous if the height levels of the horizontal cuts were exchanged and such free movement of the substantially horizontal cutting to obtain a prefered design is demonstrated by FIGS. 10, 13, 14. For instance the blank of FIG. 22 shows the shape produced by the horizontal cutting and used to improve the separation so available.

FIG. 15 shows the lower structure of the carton according to the blank shown by FIG. 5 where all the side walls are the same length and it is assembled and the bottom is being erected by the angular displacement of the side walls adjacent vertical corner folds 11:5 and 13:5 through the connection by diagonal folds 25:5 and 26:5 respectively while separater 16:5 and 17:5 are erected by their connected angular opposition and 18:5 and 19:5 are erecting by their connected angular opposition also until they are all displaced through a rightangle. FIG. 50 shows the lower structure of FIG. 14 and the upper structure of FIG. 10 to show that the same invention includes such free exchange in the assembled folded and glued blank laying flat and wherein all references have their previously described meaning.

FIG. 17 shows the assembled carton of FIG. 50 after it has been erected and it therefore shows all of the references with their previously described meaning. Like FIG. 13 it includes the distribution of stress in one of the four upper separaters by applying a triangle of forces and showing tension in the vertical component, tension in the upper angular component and compressive force in the lower angular component and as all such components are equal in the upper structure which is all equispaced about the carrying opening, the whole is in equilibrium. However the strain will try to separate the separator members and pull them apart as they are shown apart at the point of their meeting therefore it is especially important that this area is well stuck in the gluing operation. This well balanced form of the invention is one of the most useful in that it has full separation in the upper and lower structure. It will be seen that by combining the lower structures of FIG. 10 and FIG. 14 and extending the glue laps 33:9/34:9 and 33:5/34:5 double thickness separaters will result, and so it is very suitable for very heavy bottles, or for the amount of drink held by a six 12 fl oz Basket Carrier but in four 18 fl oz bottles, or four half liter bottles which are the same. This would be beneficial to both public and producers because the bottles would cost much less and save on energy which has resulted in a trend toward the larger bottles.

The separaters as shown in FIGS. 10, 14, 15, 16 include the outer part of their hinging line of weakness and having the general reference 27, 28, 29, 30, all cut through. This is because the resistance of these hinges is too great where they are erected from force applied to one end only. Preferably the line of weakness is prefolded to loosen the fibres and form a free hinge, either by using a rightangle gluer or by using the device shown for the purpose, see FIGS. 36 to 41.

The arrangement of upper structure according to the invention will be seen to be the same as that used to provide separation in the carton shown by FIG. 4 excepting that instead of carton material being reversed inwardly to stiffen the carrying opening from only two opposite vertical corners, carton material is reversed inwardly from four opposite corners to stiffen the carrying opening of FIG. 17, two from corners fully folded in the carton assembly and two from corners which are flat in the assembled carton and which will be folded and so reversed inwardly when the carton is erected.

Figure 18:
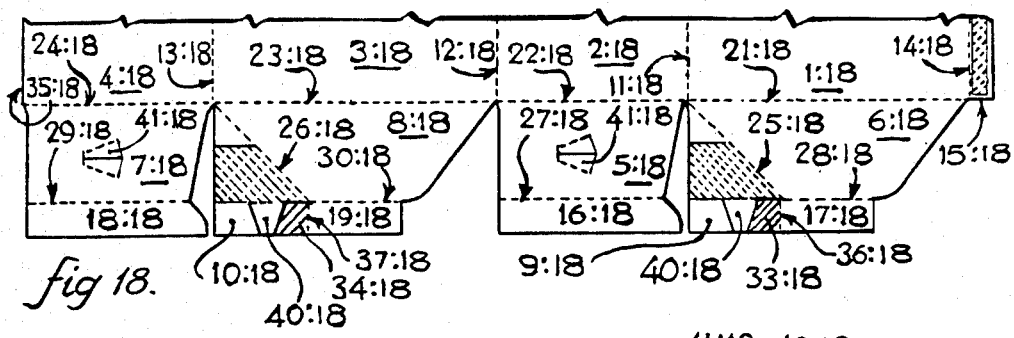
FIG. 18 shows a flat blank complete including short separaters.

FIG. 18 shows a blank for lower separation according to the invention as seen from the outside and which provide an "H" shape separation instead of the two back to back "L" shapes previously described. This is done by lengthening the separaters 16:5 and 18:5 to be as 16:18 and 18:18, and also shortening 17:5 and 19:5 to 17:18 and 19:18 which the advantage that the same amount of separation is provided but it also provides the opportunity to for the inclusion of narrow separator 40:18.

The blank is assembled by folding the bottom members 7:18, 8:18, 5:18, 6:18 at horizontal lines of fold 24:18, 23:18, 22:18, 21:18 to lie against their respective side wall inner sides, folding the diagonal glue laps 10:18 and 9:18 to overlie the bottom panel members 8:18 and 6:18 respectively, adding adhesive to the shaded areas and to the reverse of the areas shaded by broken lines and folding fully the folds 13:18 and 14:18 for the adhesive of the glue lap of 15:18 to join to the free edge 35:18.

Figure 19:
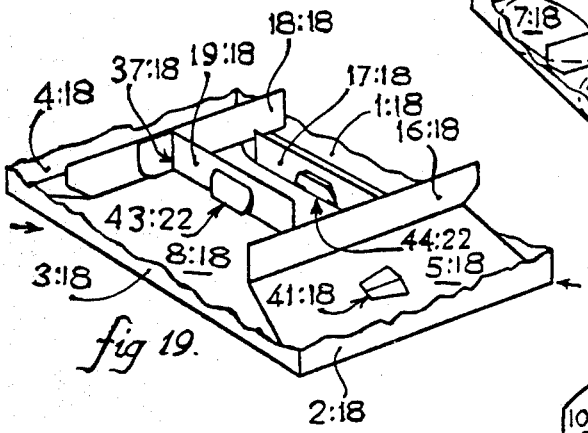
FIG. 19 shows the lower part of FIG. 18 glued together and being erected.

FIG. 19 shows the blank of FIG. 18 being erected where it is seen that the glue lap 34:18 of FIG. 18 is fixed so that the hinged edge 37:18 of FIG. 19 will oppose and erect the separator 18:18 similarly glue hinge 36:18 (hidden) will erect the separator 16:18. The opposing force between the separators 19:18 and 18:18 through the resistance offered by their stiffness is readily apparent because they are necessarily face to face in the flat assembled blank shown by FIGS. 18 and 51, and again in FIG. 19 where they are angled one to the other and it is not possible for separator 19:18 therefore to slip out of opposing contact with separator 18:18 until they are at rightangles one to the other, by which time they are both erect and separator 19:18 is opposing the similar opposing separator 17:18, the ends of which will support both separator 18:18 and 16:18. However the hinged edges 37:18 and 36:18 are important for practical control.

Figure 20:
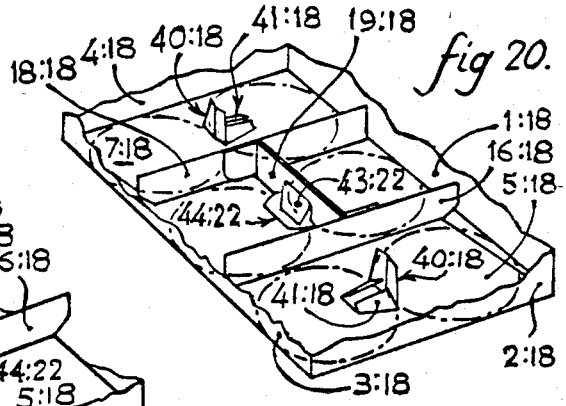
FIG. 20 shows the blank of FIG. 19 erected and short separaters erect, also locking.

FIG. 20 shows the assembled blank of FIG. 19 erected and the tabs 40:18 next to the glue laps 33:18 and 34:18 now out of sight below the trap-door-like opening 41:18 so that it is only necessary to provide support around the inside of the opening 41:18 and to raise the tabs 40:18 by hinging them tip first through the opening flaps which will return to keep the tabs 40:18 in vertical condition so so that they will keep separate any cylindrical shape containers because they can only make line contact so that even a narrow tab like 40:18 will provide just as much separation as a full length separator.

Figure 51:
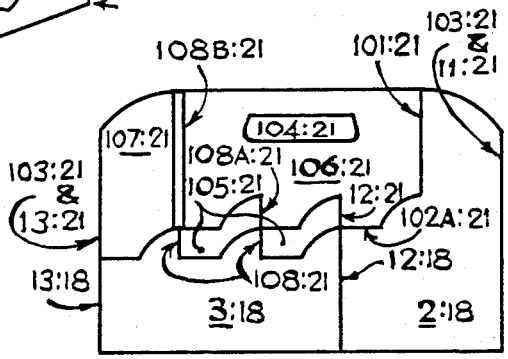
FIG. 51 shows the flat folded and glued blank before erecting as FIG. 21.

FIG. 19 also shows a locking arrangement not included in the blank shown by FIG. 18 and it is shown in the blank shown by FIG. 22 and so the parts carry the suffix 22 to avoid the need for repeating the drawing later in the description. FIG. 51 shows the lower separation structure of FIG. 18 assembled with suitable upper separation structure for six containers.

Figure 21:
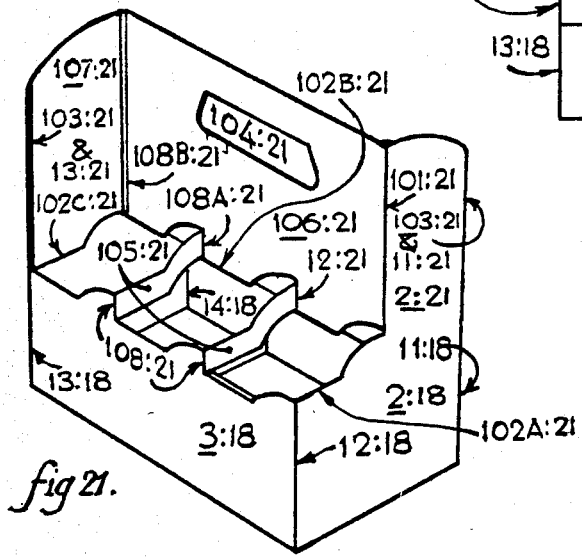
FIG. 21 shows the blank of FIG. 20 with a suitable erected upper separation complete.
Figure 58:
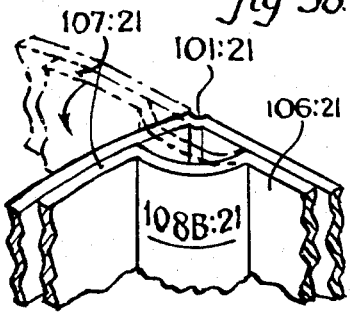

FIG. 21 shows the assembled carton of FIG. 51 in the erected condition. FIG. 22 shows the inside of a flat blank for the upper structure seen in FIGS. 51 and 21 along with a variation of the flat blank shown by FIG. 18 and which will erect in basically the same manner as shown by FIGS. 19 and 20. It is helpful at this point to have all of the blank drawings grouped for comparison purposes.

Figure 30:
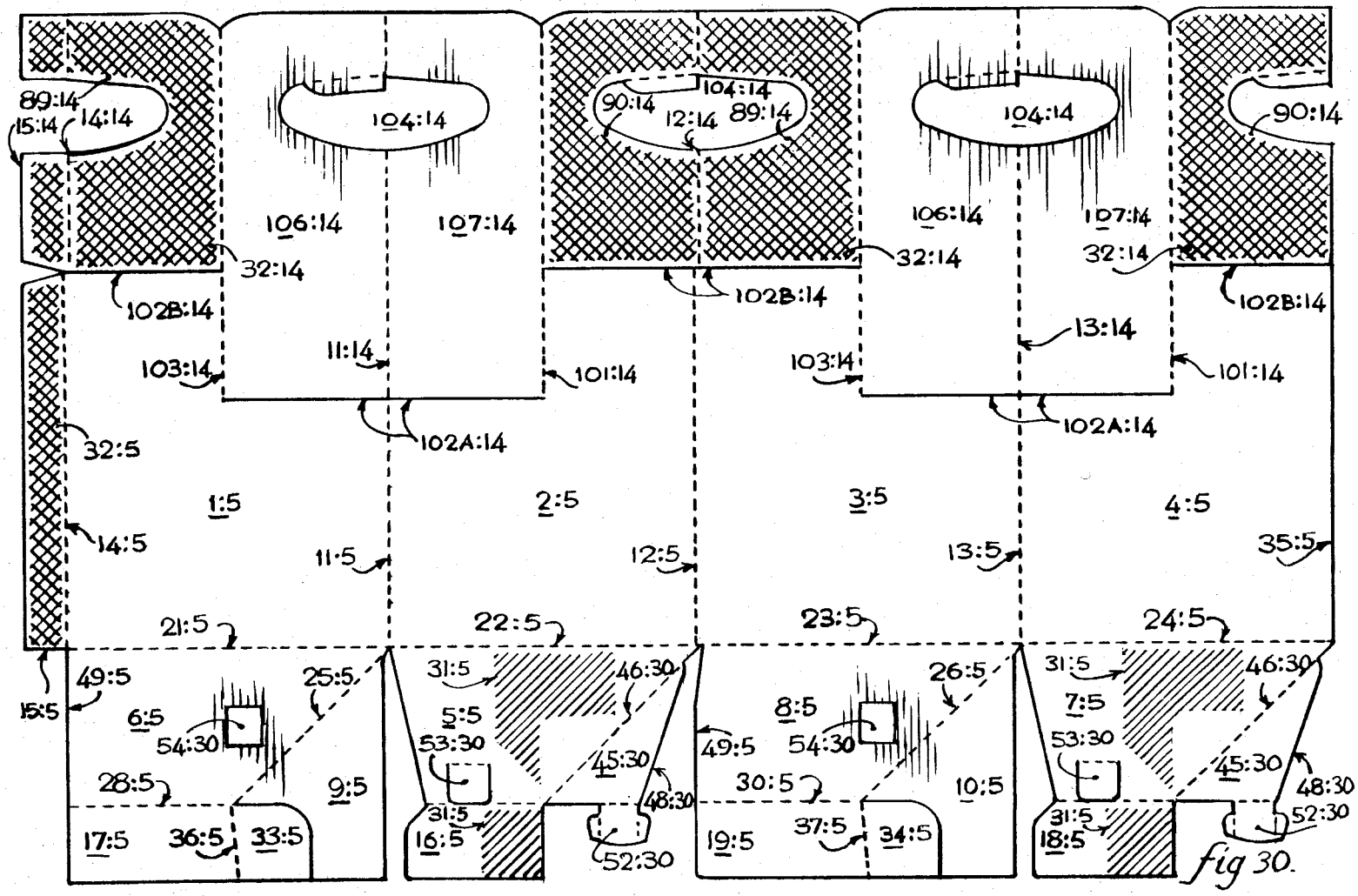
FIG. 30 shows a flat blank complete with lower separater stitching and upper separation for four articles.

FIG. 30 therefore shows a flat blank for the upper separation structure of FIG. 14 already described along with a variation of the lower separation structure first described for the blank shown by FIG. 5.

Figure 22:
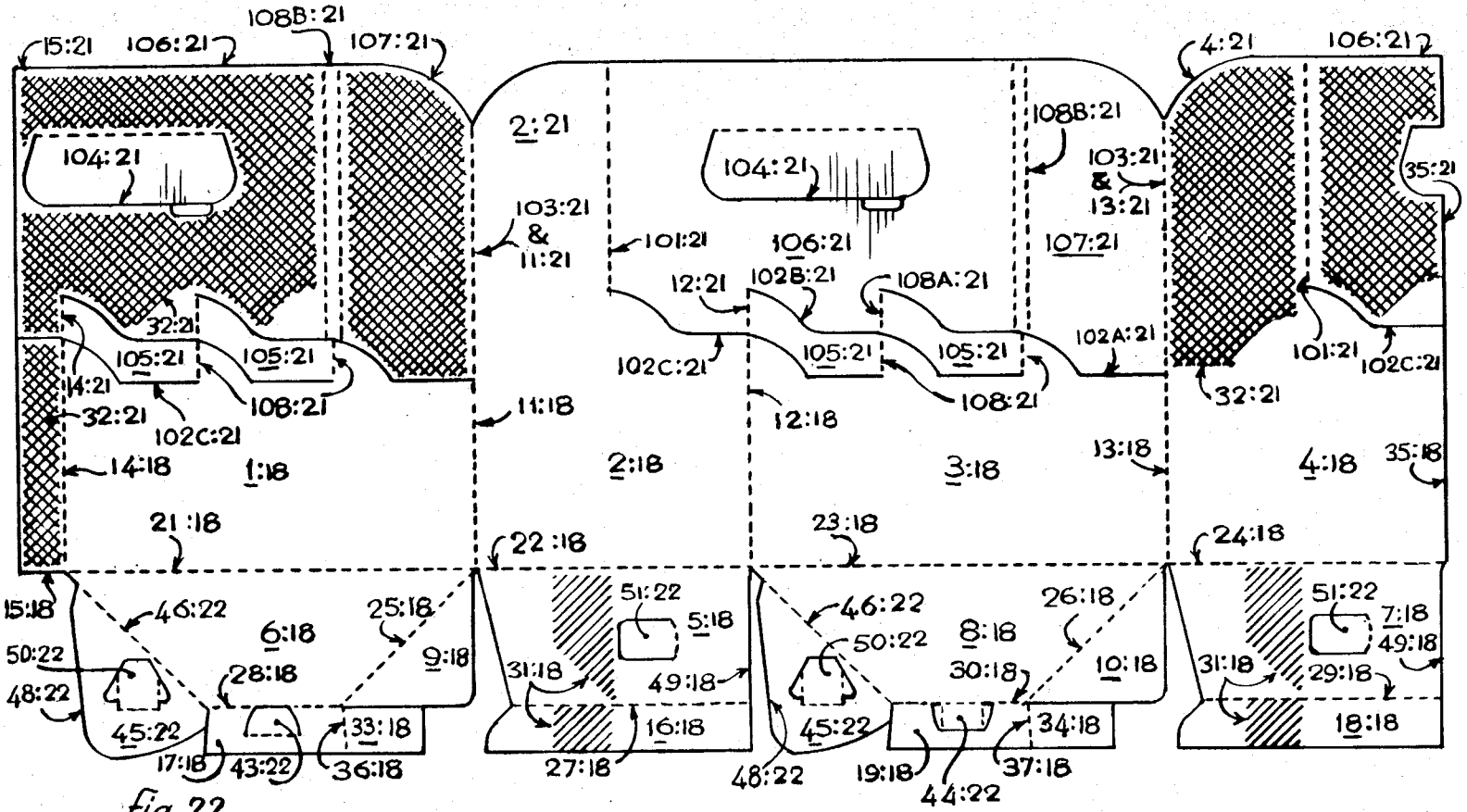
FIG. 22 shows a flat blank complete with lower and upper separation and stitch.

As in FIG. 13 the blank shown by FIG. 22 makes use of carton material reversed inwardly according to the invention as shown in the recognisable form of FIG. 21 therefore the suffix used for this upper structure shown in FIG. 22 and 21 and in the lower structure it is suffix 18.

Vertical corner fold 12:18 divides side wall 2:18 and 3:18 and they cease to have their full width at the substantially horizontal line of cut 102C:21 connecting the lower end of vertical fold 101:21 and 108:21 having the further vertical fold 12:21 therebetween so that the carton material above the cut 106:21 and 105:21 is inwardly reversible with 106:21 contributing stiffness to the carrying opening 104:21 and resulting in corner fold edge part of the carton being formed at vertical fold 108:21 and which can therefore have a substantially horizontal cut 102B:21 above it connecting with vertical folds 12:21 and 108:21 and having the further vertical fold 108A:21 therebetween so that the carton material above the cut 106:21 and 105:21 is inwardly reversible with 106:21 continuing to contribute stiffness to the carrying opening 104:21 and resulting in a vertical corner edge part of the carton being formed at vertical fold 108:21 and which again has a substantially horizontal cut 102A:21 above it connecting with vertical folds 108A:21 and 13:21 and having the further vertical fold 108B:21 therebetween so that the carton material above the cut, 106:21 and 107:21, is inwardly reversible with 106:21 continuing to contribute stiffness to the carrying opening and 107:21 also contributing stiffness to the carrying opening through 108B:21. Such chain definition of the invention could continue and include 13:21 which is notable in that it is also in the active role accorded to reference 103:21 and which is complimentary to the co-operating vertical fold 101:21 between which carton material is inwardly reversible for the purpose of contributing such stiffness.

The similar inward reversal of carton material prevails in relation to the opposite corner of the carton lower structure which is 14:18 and which divides the other two side walls 4:18 and 1:18 above which the inward reversing is repeated. The side walls 1:18 and 4:18 are made as one continuous surface by joining the glue lap portions 15:18 and 15:21 with the free edges 35:18 and 35:21. Adhesive is applied to the inside area shown 32:21 as seen at the areas shaded by double oblique shading lines and to the reverse side area shown 31:18 as seen at the areas of single oblique shading lines and the bottom members are folded according to the description for the blank of FIG. 18 with the result that when the side wall 4:18 is overfolded to fold 13:18 fully and side wall 1:18 is overfolded to fold 11:18 fully the adhesive will adhere to the areas to he united and the side walls 4:18 and 1:18 will combine to form a mirror image over the walls 2:18 and 3:18 and because said inward reversing is generated from corner 12:18 and 14:18, which are not folded in the assembled blank, they will not reverse inward until the carton is erected. Whereas had the inward reversing been generated from corner 11:18 and 13:18 then the inward reversing would have to be carried out at the time of assembly and it would reverse fully but on erecting it would be reversed only sufficient to form rightangularly. So the easiest and fastest form for folding is where only two opposite reversings take place and only upon erecting the blank, as the blank of FIGS. 55 and 22 ar designed to do. It is also possible to take the view that the carton material inwardly reversible is between 101:21 and 103:21 as in the case of FIG. 30 being 101:14 and 103:14 but it is unsuitable for definition purposes since the continuity of the substantially horizontal cutting is crucial to the action.

A feature of the invention and running through all of the blanks considered is that it has improved economy by the glue lap of the carton lower structure hinged to a side wall free edge by a fourth line of vertical corner fold for joining it to the other side wall free edge along its lower portion on assembly having an upper portion of the lap extension forming a part of the separater panel member of the carton upper structure by continuing beyond the substantially horizontal cut and joining to the separator panel member other free edge.

Therefore although the invention includes that the glue laps having the generic reference 15 may be sufficiently wide to contain the adjacent upper separater panel's full width so that it can also contain the end of the substantially horizontal cut for keeping it closed and enabling the blanks to be fed smoothly from the magazine of a gluing machine, the blank of FIG. 22 is more economic by dividing the cut 102C:21 and, where necessary, closing it near the open ends by a weak bridge which can be broken after it has enabled the blank to be fed from the magazine.

As shown in FIG. 22 only two of the lower structure vertical corners are used to enable carton material to reverse inwardly whereas all four corners are used in the blank of FIG. 30 and because, in FIG. 22, the carton material is reversed inwardly only upon erecting the carton.

Because the carton material reversed inwardly is back to back with other carton material the inside reverse fold carries the reference "B" as previously defined when describing the reference 12B:4 of FIG. 4. Therefore FIG. 22 includes the reference 108B:21 and it is formed as previously described because when assembled it must be enabled to perform similarly upon erecting.

The straps 105:21 are defined by substantially horizontal cuts 102A:21, 102B:21, 102C:21 and they level out on three distinct levels to produce the straps 105:21 on two levels with the improved result that the separaters 106:21 will, when combined, have a continuous bottom edge for separating as seen in FIG. 21 and caused by the middle level of the cutting lines, which will also provide the highest point of separation by the strap 105:21 adjacent the contact point made by a cylindrical container.

The separater 17:18 and 19:18 are seen in FIG. 19 and 20 to oppose each other and for the purpose of securing the bottom from side wall 3:18 to side wall 1:18 it would be seen to be beneficial to fix them together to resist the separating force from a load and one such method for fixing is to provide a stitch from one member through the other and which can be made from the carton material as included in FIG. 22 wherein the tab 44:22, with side barbs hinged beyond the lines of bending shown by broken lines, is pushed through the opening 43:22 where the side barbes will reopen and become secure behind the line of weakness 28:18 and shown secured in FIG. 20. The important object is to secure one similar opposing lower structure member by a stitch through the other by a nonreturnable stitch tab of the carton material.

The lower structure of FIG. 22 shows a narrow separater tab 50:22 which is closely related to the narrow separater 40:18 of FIG. 18 because it can be rotated point first through the opening left by tab 51:22 when it is displaced and which will return to maintain tab 50:22 vertical as a narrow separater and perform also as a stitch through from one similar opposing structure to lock above the other similar opposing structure due to side barbs shown hinged by lines of fold, indicated by broken lines, and which open again after passing through the opening 51:22. Such stitching through represents an important step in the invention because the bottom fixed by the diagonal glue laps 9:18 and 10:18 are restricted to two of the four corners only and so between them they secure only one end of each bottom member panel. Now because the stitches 50:22 are included in additional carton material 45:22 beyond a line allowing some bending 46:22 at the opposite end of the bottom member panels to diagonal fold 25:18 and 26:18, such stitches are through one similar opposing structure from the other similar opposing structure so all bottom member panels are secured at both ends due to the remaining two opposing corners being fixed together also to form a one piece bottom whether such narrow separater remain vertical or become laid over and perform only as stitches through.

The extra carton material 45:22 is additional to that normally associated with diagonal folding carton bottoms and it is made from material otherwise cut to waste but which, provided its edge 48:22 will pass in front of the edge 49:18 as viewed from the outside of the bottom as erecting it commences then the material 45:22 will slide over the bottom members 5:18 and 7:18.

Figure 23:
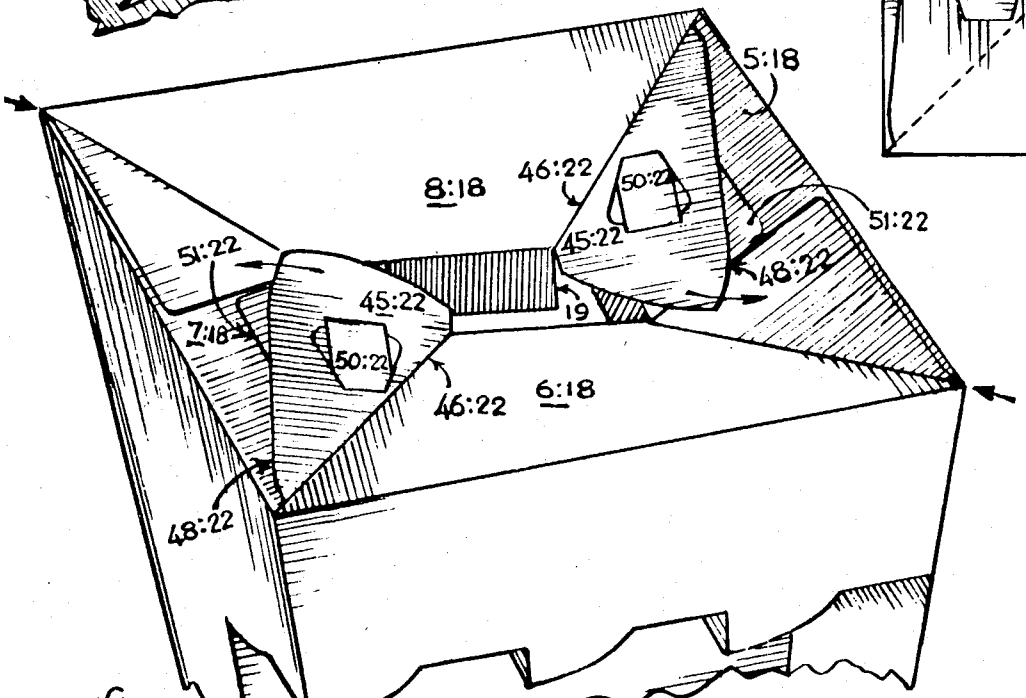
FIG. 23 shows an underside view of the blank of FIG. 22 glued and being erected.

FIG. 23 shows extra carton material 45:22 after it has been determined by the shape of its leading edge 48:22 shown by FIG. 22 to pass in front of edge 49:18 and they are sliding over bottom members 5:18 and 7:18 and bending a little at fold line 46:22 which is not always needed.

Figure 28:
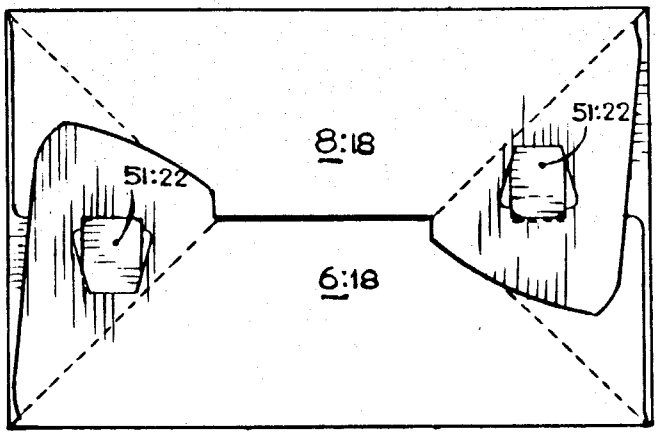
FIG. 28 shows the blank of FIG. 23 as a bottom elevation after erecting complete.

FIG. 28 shows the bottom after the sliding is completed and narrow separater and stitch 50:22 has stopped over the cut surrounding tab 51:22 and the stitch 50:22 has been pushed through the opening vacated by 51:22 and will be maintained perpendicular to the bottom inner side by the tab 51:22 urged by its line of hinge shown by broken line.

Figure 31:
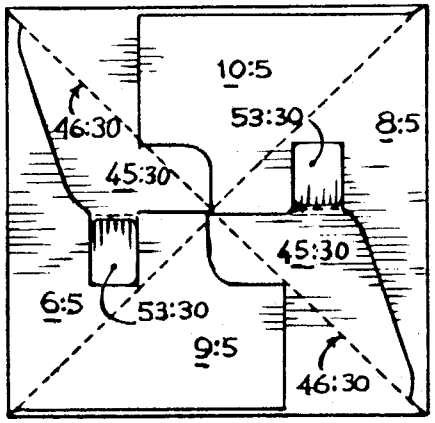
FIG. 31 shows the blank of FIG. 30 as a bottom elevation after erecting complete.
Figure 32:
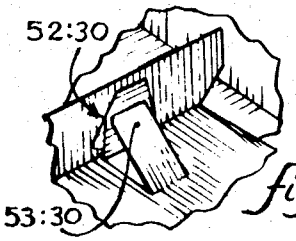
FIG. 32 is a scrap view of the stitch of FIG. 31 seen from inside the carton.
Figure 29:
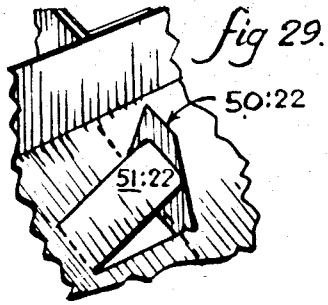
FIG. 29 is a scrap view of the short separater and stitch of FIG. 28 from inside.

FIG. 29 shows the tab 50:22 maintained perpendicular to the bottom inner side by the tab 51:22 urged by its line of hinge, shown by broken line, from the inside. FIG. 30 shows the inside of a blank for a carton for four containers having an upper and lower structure as described for FIG. 14 excepting that the bottom includes extra carton material gained in a similar manner to that of FIG. 22 and which can be used for any purpose but which is here used to form a stitch only for securing the bottom member panels across the two corners not already connected by glue laps 9:5 and 10:5. The extra material 45:30 begins at diagonal folds 46:30 which allow some flexing of 45:30 as it passes over the bottom members to stop with stitch tab 52:30 over opening 54:30 and tab 53:30 so that when stitch 52:30, with side barbs beyond the folds shown by broken lines, is pushed through the opening vacated by tab 53:30 the tab 53:30 will retain the tab 52:30 either as shown by FIG. 31 or perpendicular to the carton bottom as shown by FIG. 32 seen from the inside of the erected carton.

Figures 33, 34:
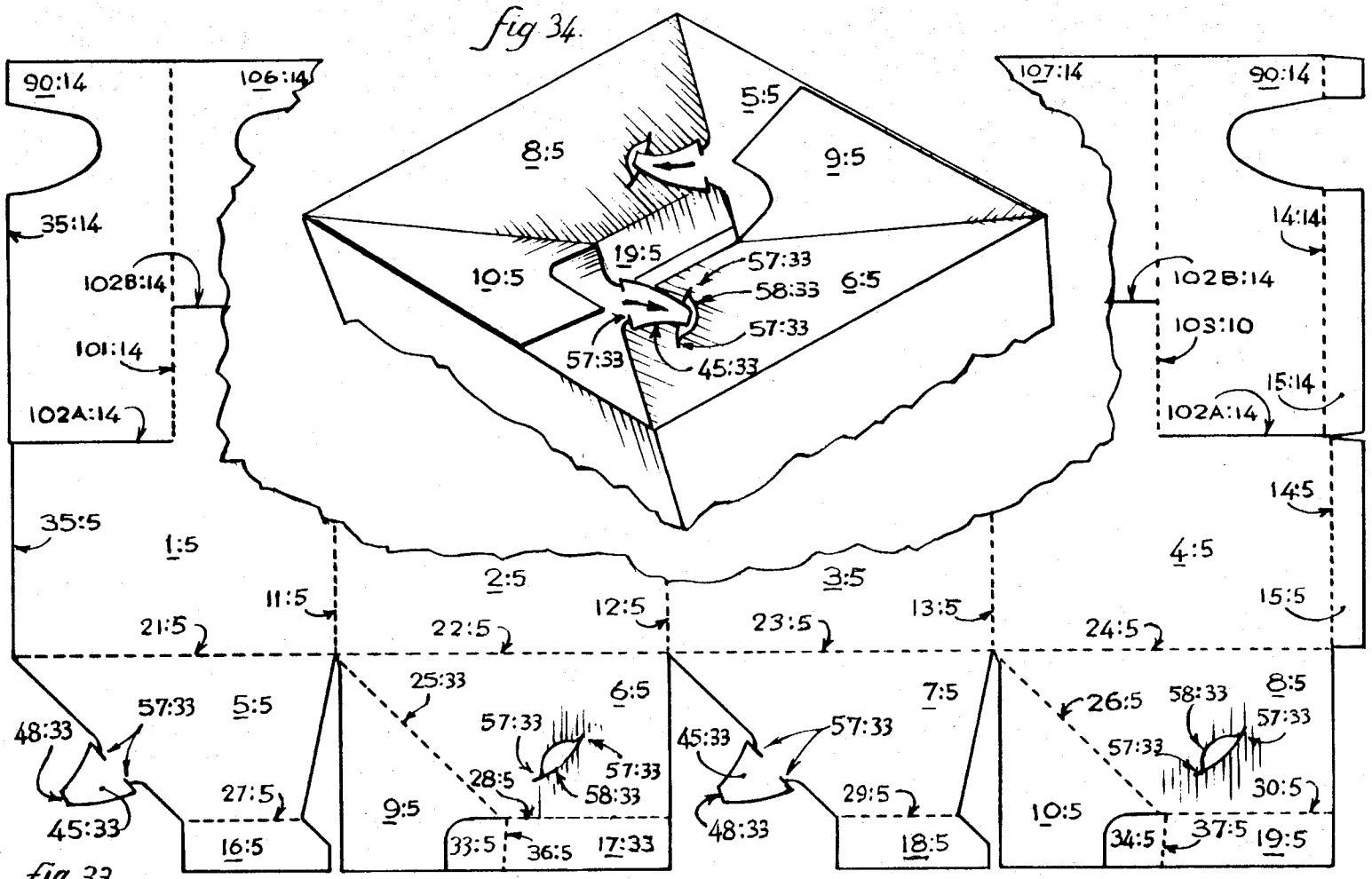
FIG. 33 shows a flat blank with automatic stitching of the bottom when erected.
FIG. 34 shows the glued blank of FIG. 33 seen from below and being erected.

In FIG. 30 double oblique shading 32:14 means that adhesive is applied to those areas or to those areas that they contact and single oblique shading 31:5 means that adhesive is applied to those areas or to those areas that they will contact. Stitching, as the name implies, is made through one similar opposing structure of the carton from the other similar opposing structure and it may be of any material including the known wire or flat wire stitch for fixing them together after erecting. Another suitable method for fixing to enable the bottom to carry a greater load is for an adhesive of any kind including hot-melt adhesive to be applied to a part of a similar opposing structure which will contact another part in the erected blank. For instance the area over which the extra carton material 45:22 or 45:30 will slide and cover parts of the bottom, could have a spot of hot-melt shot from a nozzle, or a dab of adhesive applied, because the containers when loaded into the carton will hold together the members for fixing during the open time of the adhesive and it will be set before being picked up. FIG. 33 shows the outside of a blank which is similar to that of FIG. 30 but with a more direct method for locking the two of the four corners not connected by a diagonal fold of a glue lap and which make use of extra carbon material 45:33 by providing it with a sythe-like form for operating radially about the point of junction between the horizontal line of fold 21:5 and 22:5 and vertical fold 11:5 and radially about the point of junction between the horizontal lines of fold 23:5 and 24:5 and vertical line of fold 13:5. On the radial line of travel of the sythe-like forms 45:33 and where they will strike the bottom members 6:5 and 8:5 during erecting there is an opening 58:33 and at the point where they stop after erecting the tab 45:33 is enabled to lock with the opening 58:33 by co-operating cuts 57:33 on each side of the sythe-like tabs and on each side of the opening.

FIG. 34 shows the carton being erected and the sythe-like extra carton material 45:33 entering the openings 58:33.

Figure 25:
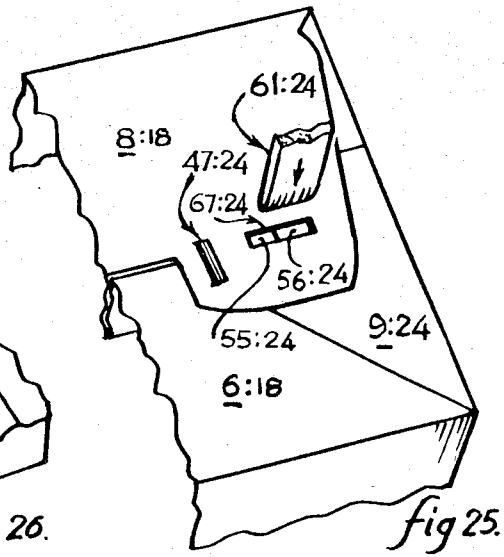
FIG. 25 shows the blank of FIG. 24 erected seen from below and being acted upon.
Figure 26:
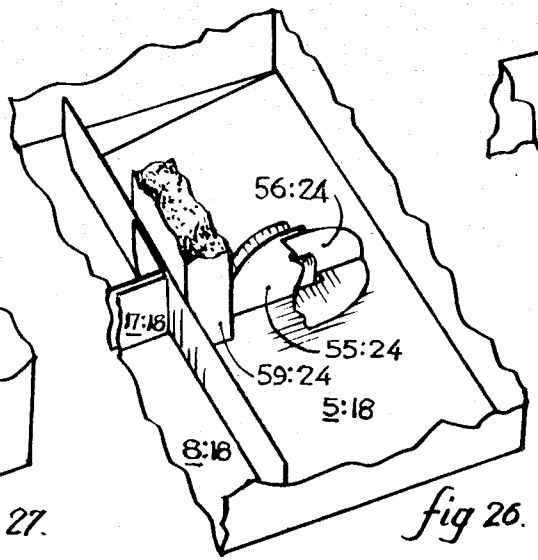
FIG. 26 shows the blank of FIG. 25 from inside and being acted upon by apparatus.
Figure 27:
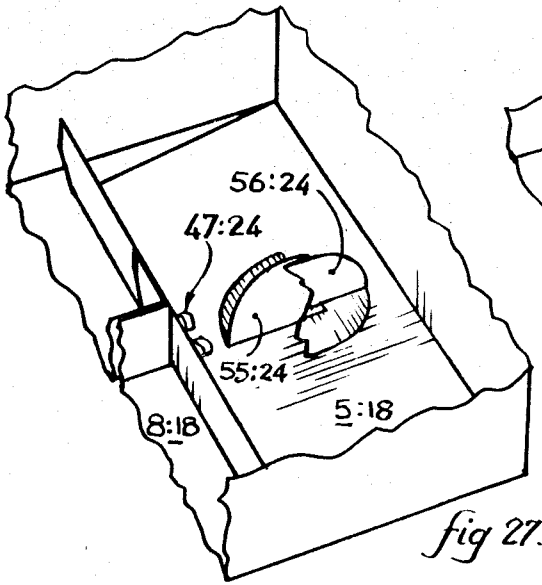
FIG. 27 shows the blank of FIG. 26 having been acted upon by apparatus.
Figure 24:
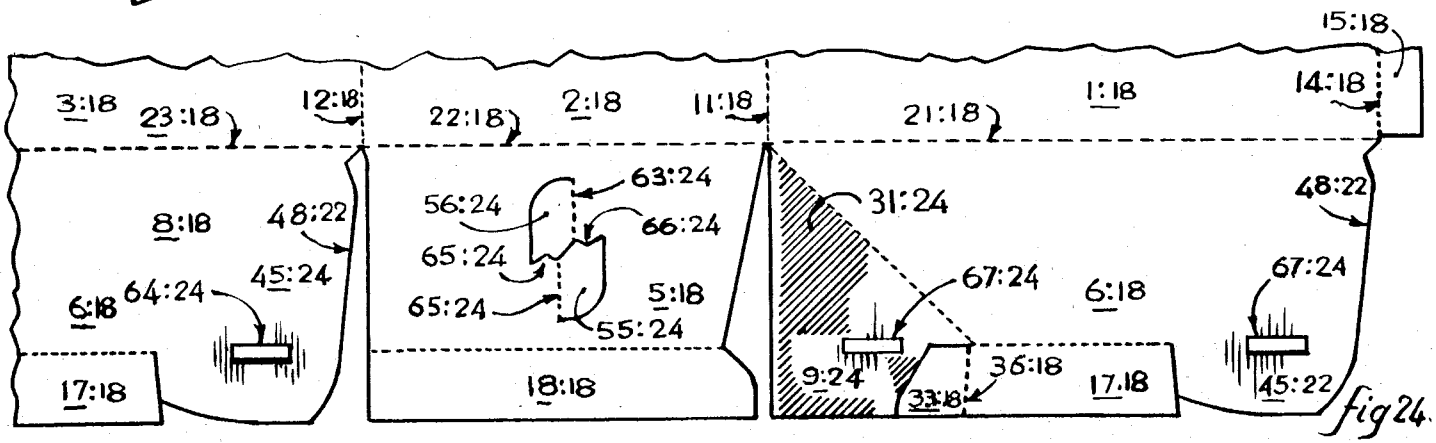
FIG. 24 shows part of the lower separaters of a flat blank with short separation.

FIG. 24 shows the outside of a blank including the three panels forming the end of the made up carton blank shown by FIGS. 25, 26, 27 which are of the form shown by FIG. 18 but varied in that the narrow separater is formed by two cut-out tabs 55:24 and 56:24 hinged at folds 63:24 and 24:24 and to cut around by a line of cut shaped to include two notches 65:24 and 66:24. These tabs are covered from the outside and the opening which would be left when they are raised is covered by the diagonal glue lap 9:24 which has the adhesive area 31:24 applied to the other side in the pattern shown by shaded lines. In the diagonal glue lap 9:24 there is provided the access opening 67:24. On assembly the bottom member panels 6:18, 5:18, 8:18, 7:18 are folded at horizontal lines of fold 21:18, 22:18, 23:18, 24:18 to lie against the inside of sidewalls 1:18, 2:18, 3:18, 4:18 and diagonal glue lap 9:24 is folded fully to overlie the bottom member panel 6:18, likewise diagonal glue lap 10:24 not shown will overlie bottom member panel 8:18 after adhesive has been similarly applied to the glue lap extension 15:18 and 33:18 it is finally folded fully at lines of fold 11:18 and 13:18 for glue lap extension 15:18 to fix with the other side wall free edge. Thus the tabs 55:24 and 56:24 remain free and the object of the access opening 67:24 is to allow the blunt edge of flat probe 61:24 seen in FIG. 25 to enter and engage the tabs 55:24 and 56:24 between their hinges for displacing them upwardly until their notches 65:24 and 66:24 engage as shown by the carton inside view FIG. 26 and maintain both tabs upright for the purpose of acting as one narrow separater as shown by the carton inside view FIG. 27.

During the action of the probe 61:24 it is necessary to ensure that the carton bottom will not lift and tha it should be restrained by a firm anvil 59:24 part of the machine which also operates the probe 61:24. Although the use of such twin interlocking tabs 55:24/56:24 is not related to the use of a flat wire stitch and such a stitch could be used with any suitable structure, the FIGS. 24 to 27 show a suitable application when the extra carton material 45:24 is included to receive the flat wire stitch 47:24 and the anvil 59:24 is used to clench it. Because the probe 61:24 would otherwise be obstructed by 45:24 another opening 64:24 is made therein to provide access. Such a stitch positioned as shown centrally and close to the line of weakness 27:18 and 29:18 will pass through extra material 45:24, 9:24 and bottom member panel 5:18 of the carton end shown. Also it is out of the way of the base of a cylindrical container which might be otherwise damaged by a hard protusion like a wire stitch.

Figure 42:
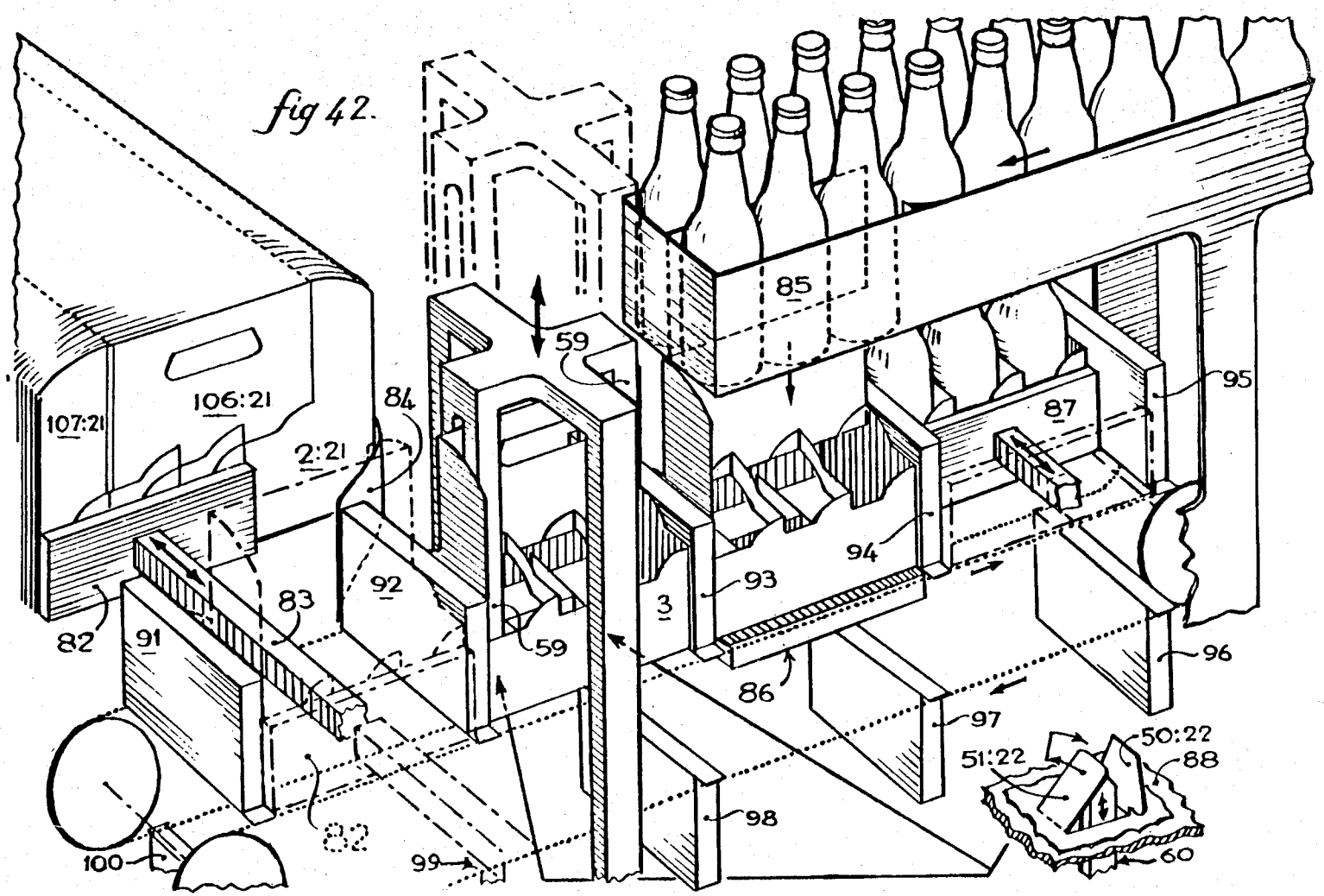
FIG. 42 shows apparatus means preparing the glued blank for its commercial use.

Such a position is also suitable for a tab stitch as previously described and cut from the extra carton material 45:24 for pressing through openings in the erected members above it so that its side barbs will collapse back as it passes through the opening and will reopen on the inside to prevent its return and for this purpose a differently shaped probe 60 is required because its leading edge is required to contact the tip of the tab first and push it through the opening in a swing action of the tab about its attaching fold as seen in the bottom righthand detail of the FIG. 42, after which the tab may lay over but it may not return below the inner side of the bottom after the probe 60 has retracted. The probes 60 and 61:24 are each different and their duties require a shape which cannot be substituted for by a human finger.

The anvil 59:24 may be a part of 59 which is a general item for entering the carton for servicing the inside and the carton general shape resulting from the inherent resistance of the folds in carton material to respond completely to the forces from the mechanical action for which it is designed, such as the opposing force from the separaters for erecting the separaters.

Such a part 59 is therefore enabled to counter such resistance and overpress the separaters in the direction that they resist most so that they return to the desired rightangular position. Similarly the folds for allowing material to reverse inwardly can be arranged to be overpressed by such an item entering from above. Such a part 59 able to enter the carton is therefore able to press onto the inside of the bottom and press it against a spring loaded plate through which such probes 60 or 61:24 project and do their job while remaining stationary therefore it may be included in a machine for erecting the carton, as described later.

Figure 180:
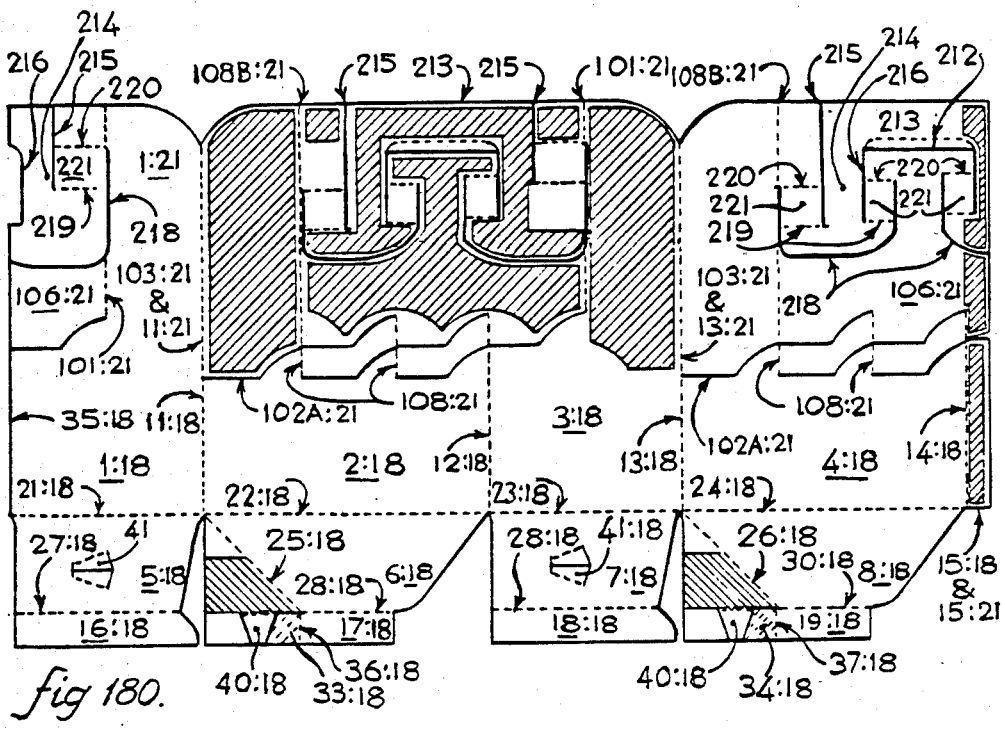
Figure 47:
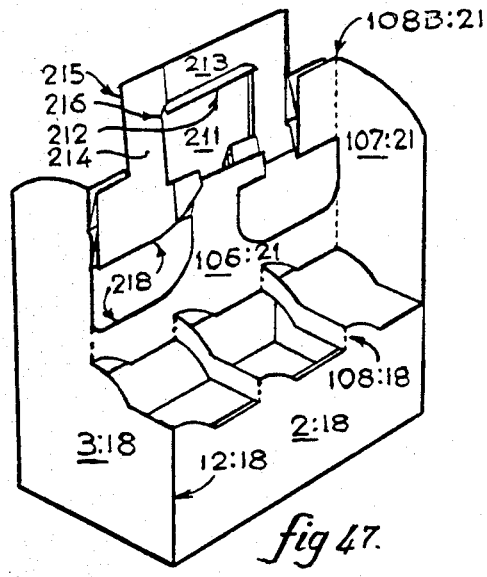
FIG. 47 shows the blank of FIG. 46 with its handle expanded for the customer to carry.
Figure 46:
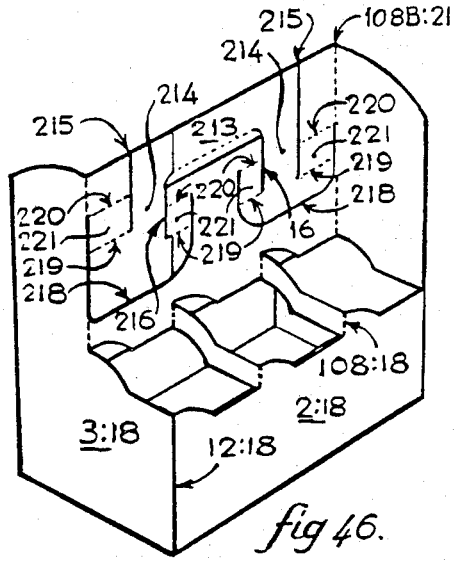
FIG. 46 shows the flat blank of FIG. 18 erected ready to hold six bottles or other.

A further feature of the invention relates to the opening in the central separater for carrying the carton with separaters. A disadvantage of such cartons when used as a carrier for bottles for instance is that the fingers must be pushed down among the crown closures of the bottles in order to grasp the finger hole and bar above it for carrying therefore a feature of the central separater 106 is that it may have a carrying bar cut out of it, which due to the position of certain cuts and folds at each end of the carry bar, the carry bar can be raised above the normal height of the carton so that it is more inviting to the prospective purchaser. Such a carrier is shown by FIG. 46 erected and FIG. 47 the handle raised. FIG. 180 shows the blank for such upper separation for six bottles where broken lines are lines of fold and full lines are lines of cut, 211 of FIG. 47 wherein its upper edge shown 212 is the lower edge cut of a horizontal strip 213 forming a carrying bar continuous with connecting strips 214 depending from its each end, the connecting strips 214 defined by substantially vertical cuts 215 outer and 216 inner, each respective connecting strip 214 lower end surrounded by separating vertical cuts each side of it and the lower ends of the vertical separating cuts 218 being connected below the connecting strip lower end by a horizontal cut and the upper ends of the vertical separating cuts higher than the lower ends of the connecting strip 214 by an amount equal to half of the height by which the carry bar 213 is required to rise to form an opening 211 below the lower edge 212 of the carry bar 213 and facilitated to rise by horizontal lines of fold 219 outward from the lower end of each connecting strip to the respective vertical separating cuts 218 and inward folds 220 from the upper end of each respective separating cut 218 to the respective surrounding connecting strip 214 for providing a chain of linked panels 221 on each side of the carry bar 213 to enable it to be carried easily after raising the carry bar from the position seen in FIG. 46 to the position shown in FIG. 47. The carrier blank of FIG. 180 is assembled in its lower structure as described for FIG. 18 and in its upper structure as described for FIG. 21. The adhesive is shown applied to the areas shown shaded by single oblique lines, being the inside uppermost, and by broken oblique lines on the reverse. Here again adhesive can also be applied to the areas to which the shaded areas will contact upon folding and in fact this would be the better method because the drive belts will press onto the shaded areas but it is better to show the areas of adhesive all together while the other two parts to be joined, to form one, show the various cuts and folds which are also repeated on the upper part of panels 2:18 and 3:18 because as shown in FIGS. 180, 46, 47 two of the said upper separater panels are cut and provided with lines of fold and they are superimposed one upon the other back to back with adhesive between them but because it is impractical to attempt to provide that all the cuts made in the upper structure of panels 2:18/3:18 should coincide with all of the cuts made in combined upper structure panels 1:18/4:18, they are deliberately off-set in each panel considered relative to a centre line of each panel so that when both panel combinations are made the same and turned back to back one side will withdraw one way and the other side will withdraw the other way freely.

As shown the glue lap extension 15:18 forming a part of the lower structure and 15:21 for forming a part of the upper structure, will overlie the side wall and upper separator and whereas this is found to be the strongest method throughout the examples shown, it is quite acceptable for the first side wall to overlie the glue lap extensions of the fourth side wall or for the first side wall to carry the glue lap extensions themselves. This applies to all examples.

As previously shown, although the upper structure of FIG. 18 looks very different to the upper structure of FIG. 14 its fundamental difference is that in FIG. 21 only the two vertical corner parts which are flat in the erectable blank are used to form carton material reversible inwardly, whereas in FIG. 14 the two vertical corner parts which are left flat and the two vertical corner parts which are folded fully in the erectable blank are all used to form carton material for reversing inwardly.

Similarly the above described raisable handle applied to the upper structure of FIG. 21 can also be applied to the upper structure of FIG. 14.

Figure 43:
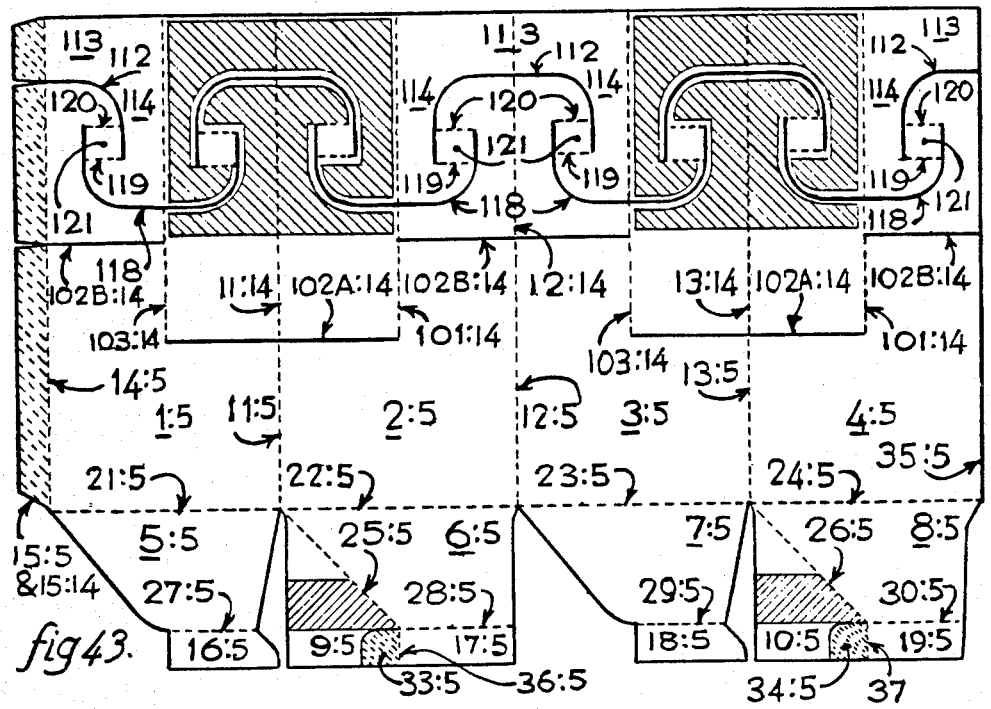
FIG. 43 shows a flat blank complete with upper separation according to the invention.

FIG. 43 shows the inside of a blank for assembling in the manner described for FIG. 14 excepting that adhesive is applied according to the areas shown shaded by oblique lines and to the reverse side where shown shaded by broken oblique line and also with the exception that the glue lap extensions 15:5 forming part of the lower structure and glue lap extension 15:14 forming part of the upper structure is prepared to join to the inner side of the side wall 4:5.

FIG. 44 shows the blank of FIG. 43 after assembly and erected for bottles.

Figure 45:
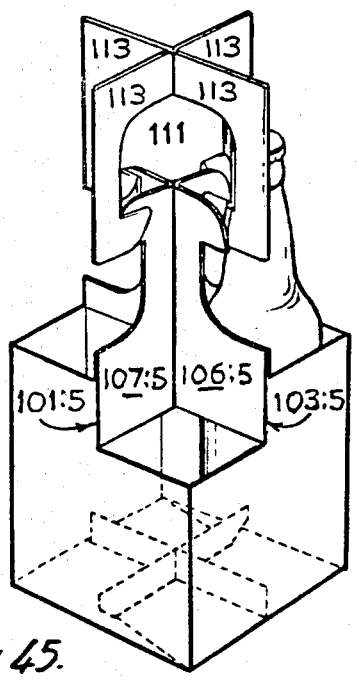
FIG. 45 shows the blank of FIG. 44 with its handle expanded for the customer to carry.

FIG. 45 shows the erected carrier with the handle raised for carrying with the fingers clear of the bottle tops.

The arrangement of cuts and folds are shown by references which have the same meaning as in FIG. 180 in which the reference began with a 2 whereas in FIG. 43 they begin with a 1 and fundamentally it is the same excepting that in FIG. 43 the composite panels are still centrally divided but here it is by the fold line 11:14 and 13:14. The carrying opening seen in FIG. 45 reference 111 defined by cut 112 below the horizontal strip 113 forming a carry bar continuous with connecting strips 114 depending from its each end, the connecting strips 114 defined on the outer edge by the natural edge of the separator of FIG. 14 and at the lower ends by the vertical separating cuts 118 being connected below the connecting strip lower end by a horizontal cut to make continuous each cut 118 with the upper ends of the vertical part higher than the lower ends of the connecting strip 114 by an amount equal to half of the height by which the carry bar 113 is required to rise to form an opening below the lower edge 112 of the carry bar 113 and facilitated to rise by horizontal lines of fold 119 outward from the lower end of each connecting strip to the respective vertical separating cuts 118 and inward folds 120 from the upper end of each respective separating cut 118 to the respective surrounding connecting strip 114 for providing a chain of linked panels 121 therebetween on each side of the carry bar 113 to enable it to be carried easily.

Because the invention extends from the flat cut blank through its assembly into a flat folded and glued blank an example of a practical machine which includes the process of folding and gluing the carton blank is here provided.

Figure 35:
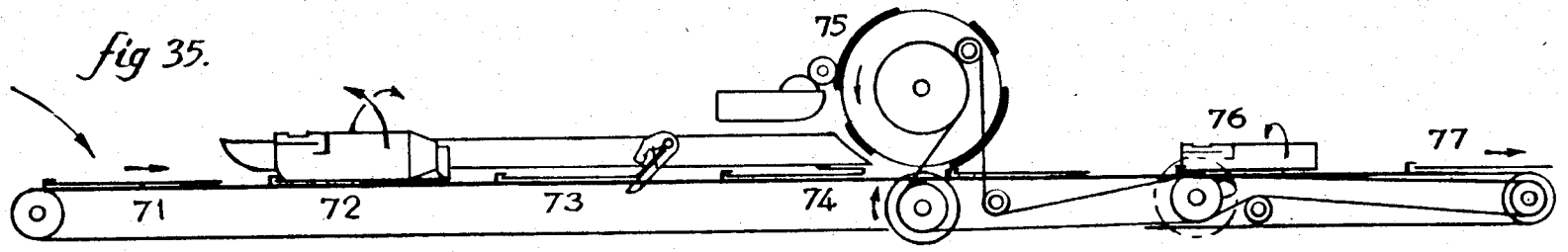
FIG. 35 shows the main stages in the process of gluing the blank together.

FIG. 35 shows the elements of a process or machine system for gluing the bottom and separaters according to the invention and shown as stages.

Figures 39, 40, 41:
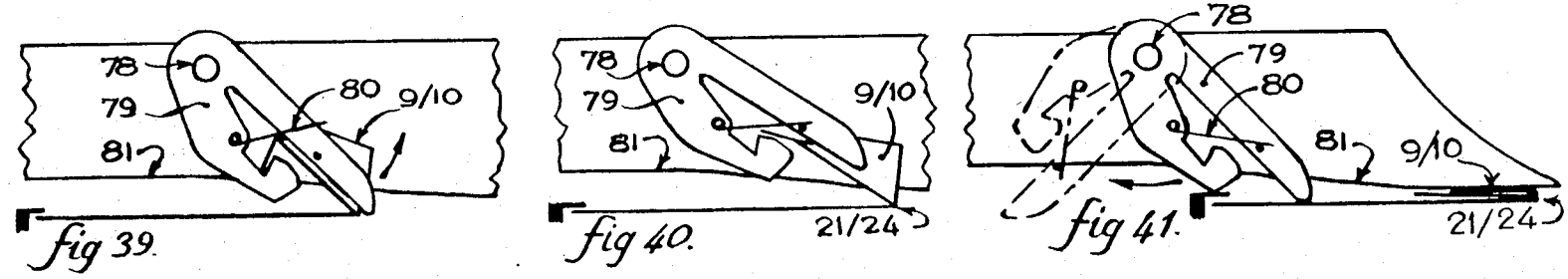
FIG. 39 shows a later stage following FIG. 38 opening the prebend and further folding.
FIG. 40 shows a later stage following FIG. 39 the glue laps folded with the bottom.
FIG. 41 shows the blank bottom folded according to the invention and leaving.

Stage references are: 71 infeed of a flat blank located by a flight on a chain for controlling and synchronising the blank with the actions of the machine through gluing by a patterned stencil, known as timed pattern gluing, and special folding: 72 prebending of the vertical lines of fold for folding fully in the final fold section; the bottom member panels folded at the horizontal lines of fold for folding fully and for the bottom member panels to overlie the side walls with the diagonal glue laps folded fully to overlie their respective bottom members panels; 73 the bottom is being folded according to FIGS. 36 to 41 described in detail below; 74 following the stage shown by FIG. 41 the folded blank is about to pass below the glue imprinting cylinder; 75 glue imprinting cylinder for stencilling a specific pattern of adhesive by adhesive fed through rollers onto an elastomeric sterio (such as the known process belonging to the Asahi Chemical Industry Co of Japan) for imprinting the intricate shape of the adhesive application required; 76 folding fully the folds for folding fully including the folding of any reverse folds for folding fully and allowing carton material to reverse inwardly for contributing stiffness to the carrying opening panel by the use of a lifter of some form such that side walls one and four will overlie side walls two and three and such that the glue lap extensions between side walls one and four for joining them will join them; 77 the carton in flat assembled condition is pressed while the adhesive fixes.

FIGS. 36 to 41 show a device for prebending the lines of weakness between the separators and their bottom panel member's free edge for the purpose of loosening the fibres locally such that it is enabled to bend automatically when the carton is erected, otherwise these lines of weakness must be further weakened by cutting through intermittently known as skip-scoring. The device will also fold the bottom panel members and the diagonal glue lap.

Figures 36, 37, 38:
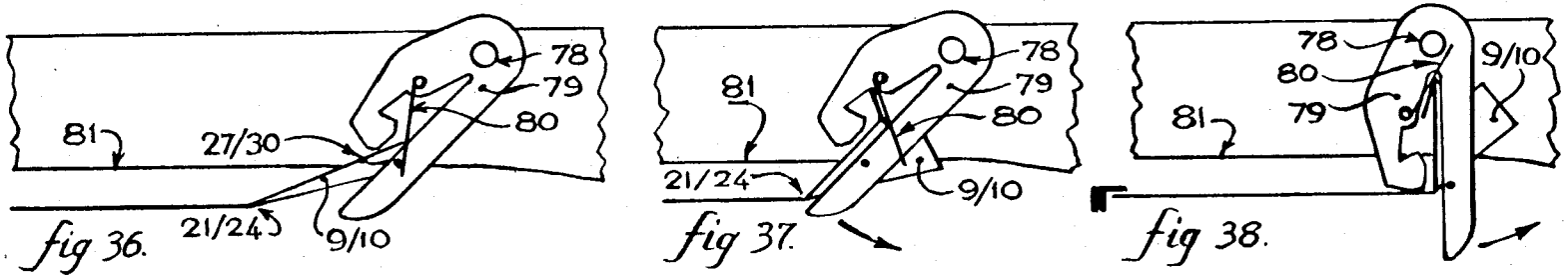
FIG. 36 shows the flat blank entering a folding device for preparing the invention.
FIG. 37 shows a later stage following FIG. 36 of prebending and folding.
FIG. 38 shows a later stage following FIG. 37 having prebent and further folding.

FIG. 36 shows the device which is a new device and which can be used for prebending the lines of weakness generically having the reference 27 to 30, for fully folding the diagonal folds generically having the reference 9 and 10, and for fully folding the horizontal lines of fold 21 to 24. The device is 79 and it is pivoted on cross-bar 78 and as shown the blank is driven bottom first to enter the internal shape of the device 79 while the diagonal glue laps 9 and 10 are prevented from rising by guide rail 81 and the bottom members rise by bending at horizontal lines of fold 21 to 24.

FIG. 37 shows the separaters generically referred to as 16 to 19 being deflected by deflecter 80 and diagonal glue laps 9 and 10 being bent back under their respective rail 81 by the action of their respective device 79 spaced out along the cross bar such that one will serve each of the members depending from a side wall and progressively bend them back over the side walls.

FIG. 38 shows the deflector itself deflected and 79 pivoted until vertical on 78 the folds 27 to 30 folded fully, the diagonal folds bent further back and the horizontal folds 21 to 24 bent through rightangles.

FIG. 39 shows the device 79 moved to the far side of centre and the deflecter regaining its position, the folds 27 to 30 unfolding, the diagonal glue laps 9 and 10 overlying the bottom panel members which are overlying the side walls FIG. 40 shows the device having reached it rearmost point and the blank folded and leaving the device to pass under the rail 81 with the diagonal folds of the glue laps 9 and 10 folded fully the horizontal folds 21 to 24 folded fully and the lines of weakness 27 to 30 having all been fully prebent. FIG. 41 shows the blank folded and leaving the device and about to allow the device 79 to assume its original position. the above device therefore is an alternative to the known method of Hooks used for folding the diagonal folding bottoms for cartons on an in-line gluer.

Because the invention includes the erecting of the assembled carton into a carton for use with containers an example of a machine illustrating the process is included FIG. 42 shows a machine in which the carton is transported in indexing stages through erecting, locking the bottom and shaping, loading with bottles, ejecting. Erecting where the blank is drawn into the compartment between flight walls 91 and 92 by vacuum plate 82 on reciprocating arm 83 such that curved wall 84 will displace carbon wall 2:21 as shown until it is at rightangles to carton wall 3:21 whereupon the carton will enter between flight wall 91 and 92 and be retained erect as a consequence. The flight walls 91 and 92 will then index in the direction shown by the horizontal arrows until they are in the position shown occupied by flight walls 92 and 93 and arm 83 will remain in the position shown by the chain lines with the vacuum hold released until flight walls 91 and 100 are indexed and stopped with vacuum head 82 therebetween so that it can draw another blank from the stack of blanks maintaining a blank available to head 82 at each stroke of it. During which stroke the bottom 59 will enter the inside of the carton and press on any part of the bottom or support a separater for stitching one carton similar opposing structure to the other. Support 59 is a general item and may support any part of the bottom while an action is performed on it or it can press the bottom against a spring supported plate 88 which will resist but be overcome by the support 59 exerting pressure beyond the normal level of the bottom whereby fixed probes 60 or 61 will pass through the carton bottom while it is so clamped, see FIG. 42 bottom right hand corner detail view shown related. Such probes may perform any action preparing the carton for its commercial use and may themselves be moved, or they may apply glue for fixing the opposing structures together.

Alternatively wire stitching heads may be activated against the carton bottom for instance as demonstrated by FIGS. 25 and 26. Such a plate has many economic advantages including that it is also an ejector plate for freeing the carton in locked condition. The support 59 then lifts clear of the carton as shown by the vertical arrows and the carton indexes to the next position so that flight walls 91 and 92 occupy the position shown occupied by flight walls 93 and 94 where the articles for loading at 85 are loaded into the carton. If loading is done vertically and by gravity then the bottom of the carton will rest on a shock absorbing base 86 which may be spring supported. The carton will then index to the next position so that flight walls 91 and 92 will occupy the positions shown occupied by walls 94 and 95 and at this stage the loaded carton may be ejected from the apparatus ready for commercial use.

Such machine is capable, with adaptation, of erecting the various forms of self-erecting lower structure according to the invention combined with the many possible interpretations of the upper structure invention discussed for the advantage of economy afforded in materials, labour and energy as a consequence, relative to the known form of basket carrier for bottles.

Carton material is saved both through the avoidance of waste areas and the ability to provide a compact rectangular blank of such proportions as will combine on a printer's sheet size.

Labour is saved through the ability to print and cut more blanks at a stroke, also by increased gluing machine speeds.

Such cartons according to the invention when used as a carrier for containers also has the advantage of improved stiffness in the lower structure by the bottom being fixed on all four sides, while the upper structure has the advantage of improved stiffness by material being reversed inwardly either at the stage of erecting or at the stage of assembly of the flat blank or both.

The methods and features taught by the invention provide many obvious variations encompassed by it and all are beneficial to their users.

What I claim is:

1. A collapsible carrier for articles constructed from a blank of sheet material including a bottom comprising bottom member panels depending from the bottom edges of each of four side walls by a horizontal line of fold, each side wall hinged by a line of vertical corner fold to the next side wall, and when the carrier is folded flat into the collapsed condition and assembled two of the four said vertical corner folds lie between the two other vertical corner folds which are folded fully each with members adjacent to it forming a similar opposing structure, the adjacent bottom member panels folded to lie against the inside of the adjacent side walls and a glue lap divided from one of the bottom member panels of each structure by a diagonal fold meeting with the vertical corner fold folded fully and the horizontal line of fold, the glue lap folded to lie against the adjacent bottom member panel and glued to it, at least one substantially horizontal cut above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second cut being folded to reverse inwardly for forming separation for separating the upper parts of the articles carried and for accommodating a carrying opening, when the carrier is erected; characterised in that the free edge of at least one bottom member panel of each one of said similar opposing structures carries a separater forming extension hinging with the bottom member at a line of weakness parallel with the said horizontal line of fold and the line of weakness dimensioned to communicate with a said line of weakness of the similar opposing structure when erected and the height of the separater extensions dimensioned to finish below the carrying opening of the inwardly reversing carrier material when the carrier is collapsed, said separaters each arranged and adapted for the transmission to it of opposition force through engagement between said separater and another said separater for their rightangular displacement relative to their said at least one bottom member panel when said at least one bottom member panel and the bottom member sharing a said diagonal fold together are displaced vertically by their respective side walls of their said similar opposing structure being displaced horizontally and said carrier material enabled to reverse inwardly is displaced inwardly contributing stiffness and positioned for co-operating with the separater forming extensions of the bottom which separate the lower parts of the same said articles carried in the erected collapsible carrier which is erected by moving each said fold for folding fully one toward the other and opened to provide the said displacements.

2. A collapsible carrier as claimed in claim 1 wherein said edge engagement is provided between the face of a said separater extension engaging with and opposing another said separater extension edge and maintained in such opposition during the said rightangular displacement by each separater extension of said similar opposing structure being formed deeper to the free edge of such separater extension at one end than the remainder of the separater extension free edge such that the deeper formed portion of each edge will overlap the free edge remainder of the opposed separater face.

3. A collapsible carrier as claimed in claim 1 wherein said engagement is provided between adjacent separaters which are face opposing face in the folded and glued flat blank and are angularly displaced horizontally one relative to the other during their angular displacement vertically relative to their respective bottom members by the opposing force continued engagement through a vertical edge of at least one adjacent separater maintaining vertical contact with the vertical face of the opposing adjacent separater during and after the angular displacements experienced upon erecting the carrier said vertical edge contact maintained by a substantially vertical line of fold at a glue lap for hinging the adjacent separaters together.

4. A collapsible carrier as claimed in claim 2 or 3 wherein one said similar opposing bottom structure is secured to the other said opposing bottom structure by a stitch of any material from one said similar opposing bottom structure through the other said similar opposing bottom structure.

5. A collapsible carrier as claimed in claim 1, 2 or 3 wherein a stitch comprising a tab cut from the free edge of the bottom member panel of one said similar opposing structure and the tab is able to enter an opening made in the bottom member panel of the other similar opposing structure and the opening positioned to be in the path travelled by the tab, the tab entering the opening and making the stitch when the structures are erected.

6. A collapsible carrier as claimed in claim 1, 2 or 3 wherein a tab is cut out of a part of a similar opposing bottom structure hinged to it by a line of fold for allowing the tab to be rotated and retained perpendicular to the panel from which it was cut to provide additional separation.

7. A collapsible carrier for articles as claimed in claim 1 further characterised in that the said inwardly reversible carrier material will combine with another thickness of carrier material to form double thickness walls of carrier material back to back divided by the said further vertical fold and which further vertical fold comprises a line of embossed carrier material raised between parallel edges on the face of the inwardly reversed carrier material and wherein the back of the embossed carrier material is raised above the said face and above a prepressed line for folding in the said another thickness in the collapsed condition and in the erected condition.

8. A collapsible carrier as claimed in claim 1 including said carrying opening wherein its upper edge is the lower edge cut of a horizontal strip forming a carrying bar continuous with connecting strips depending from its each end, the connecting strips defined by substantially vertical cuts, each respective connecting strip lower end surrounded by separating vertical cuts each side of said lower end and the lower ends of the vertical separating cuts being connected below the connecting strip lower end by a horizontal cut and the upper ends of the vertical separating cuts being higher than the lower ends of the connecting strip by an amount equal to half the height by which the carrying bar is required to rise to form an opening below the lower edge of the carrying bar and facilitated to rise by horizontal lines of fold outward from the lower end of each connecting strip to the respective vertical separating cuts and inward from the upper end of each respective separating cut to the respective surrounding connecting strip for providing a chain of linked panels on each side of the carry bar.

9. A collapsible carrier as claimed in claim 8 wherein two such carrying bar wall arrangements are superimposed and each have such horizontal fold lines excepting that the horizontal fold lines of one of the carry bar wall arrangements are displaced vertically relative to the other and the contacting surfaces above and below the highest and the lowest said horizontal folds are adhesively fixed together whereby each panel between the horizontal folds will fold upward when the carry bar is lifted and maintain the fixed together surfaces substantially parallel one to the other.

10. A collapsible carrier as claim in claim 1, 2 or 3 wherein a stitch comprising a tab cut out of a part of said similar opposing lower structure part is moved through a cut out part of the other said similar opposing lower structure.

11. A collapsible carrier as claimed in claim 1, 2 or 3 wherein adhesive is applied to a part of one said similar opposing lower structure for meeting with a part of the other said similar opposing lower structure for joining the one to the other upon them being erected.

12. A collasible carrier for articles and constructed from a blank of sheet material including a bottom comprising bottom member panels depending from the bottom edges of each of four side walls by a horizontal line of fold, each side wall hinged by a line of vertical corner fold to the next side wall, and when the carrier is folded into the collapsed condition and assembled two of the four said vertical corner folds lie between the two other vertical corner folds which are folded fully each with component members adjacent to it forming a similar opposing structure, the adjacent bottom member panels folded to lie against the inside of the adjacent side walls and a glue lap divided from one of the bottom member panels of each structure by a diagonal fold meeting with the vertical fold folded fully and the horizontal lines of fold, the glue lap folded to lie against the adjacent bottom member panel and glued to it, at least one substantially horizontal cut above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second substantially horizontal cut being folded to reverse inwardly for forming separation for separating the upper parts of the articles carried and for accommodating a carrying opening and providing stiffness to the carrying opening upon folding and gluing the blank into a collapsed collapsible carrier which blank is dimensioned for erecting into a carrier for use.

13. A collapsible carrier as claimed in claim 12 wherein one end of the first mentioned said substantially horizontal cut connecting with a said line of vertical fold, is so connecting above another such connecting of the second substantially horizontal cut while the other end of the first mentioned substantially horizontal cut is connecting with a said line of vertical fold below another such connecting of another second substantially horizontal cut with a said line of vertical fold, the carrier material between the two said lines of vertical fold reversing inwardly to contribute stiffness to the carrying opening.

14. A collapsible carrier for articles as claimed in claim 12 wherein said means includes a third substantially horizontal cut located above at last one of said line of vertical folding for providing additional stiffness to the carrier opening.

15. A flat blank of sheet material for assembling into a collapsed folded and glued carrier for erecting into a carrier for articles with separaters for separating the bottom part of the articles and separaters for separating the upper part of the articles therefore the blank comprising a substantially rectangular piece of material such as paperboard divided into four side walls by three lines of vertical corner fold, a lap extension hinged to a side wall free edge by a fourth line of vertical corner fold for joining it to the other side wall free edge on assembly, each side wall having a bottom member panel depending from its lower edge at a horizontal line of fold, the first and second bottom member panels adjacent the first line of vertical corner fold for forming a similar structure to that of the third and fourth bottom member panels adjacent the third line of vertical corner fold, a glue lap divided from one of the bottom member panels of each structure by a line of diagonal fold for folding and meeting with the adjacent line of vertical corner fold and the horizontal line of fold, the glue lap inner side able to fold and lie against and be joined to the adjacent bottom member panel outer side after the bottom member panels for folding have been folded to lie against the inner side of their respective side walls and the first line of vertical corner fold has been folded fully for the first bottom member panel to overlie the second bottom member panel and the third line of vertical corner fold has been folded fully for the fourth bottom member panel to overlie the third bottom member panel and the first and fourth free side wall edges have been joined together, connected side wall parts have at least one substantially horizontal cut situated above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second cut being folded to reverse inwardly for forming separation for separating the upper parts of the articles carried and for accommodating a carrying opening therein; characterised in that the free edge of at least one bottom member panel of each one of said similar opposing structures carries a separater forming extension hinging with the bottom member panel at a line of weakness parallel with the said horizontal line of fold and the line of weakness dimensioned to communicate with a said line of weakness of the similar opposing structure when erected and the height of the separater extensions dimensioned to finish below the carrying opening of the inwardly reversing carrier material when the carrier is collapsed, said separater each arranged and adapted for the transmission to it of opposition force through edge engagement between said separater and another said separater for their right-angular displacement relative to their said at least one bottom member panel when said at least one bottom member panel and the bottom member sharing a said diagonal fold together are displaced vertically by their respective side walls of their said similar opposing structure being displaced horizontally and said carrier material folded to reverse inwardly is displaced inwardly contributing stiffness and positioned for co-operating with the separater forming extensions of the bottom which separate the lower parts of the same said articles carried in the erected collapsible carrier and which is erected by moving each said fold for folding fully one toward the other and opened to provide the said displacements.

16. A blank for a collapsible carrier as claimed in claim 15 wherein one separater of each said similar structure is greater in depth to its free edge at one end than the depth to the remainder of its free edge and dimensioned to enable the deep end to overlap and engage the free edge remainder of the other separater of the other similar structure such that they engage and oppose each other when the assembled blank is erected.

17. A blank for a collapsible carrier as claimed in claim 15 wherein at least one separater of each said similar structure carries a glue flap hingably attached at a substantially vertical line of fold for fixing and hinging with an adjacent separater of the same similar structure upon the similar structure being assembled into a flat assembled carrier such that upon erecting, the separaters of the structure will interact together until they are both erected by their opposition one to the other being transmitted angularly by the said hinging.

18. A blank for a collapsible carrier as claimed in claim 15 wherein said lap extension is hinged to a side wall free edge by a fourth line of vertical corner fold for joining it to the other side wall free edge along its lower portion on assembly and the upper portion of the lap extension forms a part of said carrier material enabled to reverse inwardly for separating its article content at their upper parts when the upper portion of the lap extension is joined to the separater panel member other free edge.

19. A flat blank of sheet material for assembling into a collapsed folded and glued carrier for erecting into à carrier for articles with separaters for separating the bottom part of the articles and separaters for separating the upper part of the articles therefore the blank comprising a substantially rectangular piece of material such as paperboard divided into four side walls by three lines of vertical corner fold, a lap extension hinged to a side wall free edge by a fourth line of vertical corner fold for joining it to the other side wall free edge on assembly, each side wall having a bottom member panel depending from its lower edge at a horizontal line of fold, the first and second bottom member panels adjacent the first line of vertical corner fold for forming a similar structure to that of the third and fourth bottom member panels adjacent the third line of vertical corner fold, a glue lap divided from one of the bottom member panels of each structure by a line of diagonal fold for folding and meeting with the adjacent line of vertical corner fold and the horizontal line of fold, the glue lap inner side able to fold and lie against and be joined to the adjacent bottom member panel outer side after the bottom member panels for folding have been folded to lie against the inner side of their respective side walls and the first line of vertical corner fold has been folded fully for the first bottom member panel to overlie the second bottom member panel and the third line of vertical corner fold has been folded fully for the fourth bottom member panel to overlie the third bottom member panel and the first and fourth free side wall edges have been joined together, connected side wall parts have at least one substantially horizontal cut situated above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second cut being folded to reverse inwardly for forming separation for separating the upper parts of the articles carried and for accommodating a carrying opening therein; characterised in that the carrier material between the two vertical folds is dimensioned for reversing the said carrier material inwardly and folding said vertical fold fully upon folding and gluing the blank into a collapsed collapsible carrier.

20. A process for assembling a moving flat blank for a carrier to the invention comprising a substantially rectangular piece of sheet material such as paperboard divided into four side walls by three lines of vertical corner fold, a lap extension hinged to a side wall free edge by a fourth line of vertical corner fold for joining it to the other side wall free edge on assembly, each side wall having a bottom member panel depending from its lower edge at a horizontal line of fold, the first and second bottom member panels adjacent the first line of vertical corner fold for forming a similar structure to that of the third and fourth bottom member panels adjacent the third line of vertical corner fold, a glue lap divided from one of the bottom member panels of each structure by a line of diagonal fold for folding and meeting with the adjacent line of vertical corner fold and the horizontal line of fold, the glue lap inner side able to fold and lie against and be joined to the adjacent bottom member panel outer side after the bottom member panels for folding have been folded to lie against the inner side of their respective side walls and the first line of vertical corner fold has been folded fully for the first bottom member panel to overlie the second bottom member panel and the third line of vertical corner fold has been folded fully for the fourth bottom member panel to overlie the third bottom member panel and the first and fourth free side wall edges have been joined together, connected side wall parts have at least one substantially horizontal cut situated above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second cut being folded to reverse inwardly for forming separation for separating the upper parts of the articles carried and for accommodating a carrying opening therein; characterised in that the free edge of at least one bottom member panel of each one of said similar opposing structures carries a separator forming extension hinging with the bottom member panel at a line of weakness parallel with the said horizontal line of fold and the line of weakness dimensioned to communicate with a said line of weakness of the similar opposing structure when erected and the height of the separator extensions dimensioned to finish below the carrying opening of the inwardly reversing carrier material when the carrier is collapsed, said separater each arranged and adapted for the transmission to it of opposition force through edge engagement between said separater and another said separater for their right-angular displacement relative to their said at least one bottom member panel when said at least one bottom member panel and the bottom member panel sharing a said diagonal fold together are displaced vertically by their respective side walls of their said similar opposing structure being displaced horizontally and said carrier material folded to reverse inwardly is displaced inwardly contributing stiffness and positioned for co-operating with the separater forming extensions of the bottom which separate the lower parts of the same said articles carried in the erected collapsible carrier and which is erected by moving each said fold for folding fully one toward the other and opened to provide the said displacements, the process comprising, the said horizontal line of fold folded for its depending bottom member panels and separater forming extensions to lie against their respective sidewalls and the diagonal fold of each similar opposing structure folded fully for the glue lap inner side to be able to lie against and be fixed to the adjacent bottom member panel outer side by adhesive applied therebetween and the adhesive applied for fixing any glue flap of a separater of a similar structure to its adjacent separater and adhesive applied for fixing said carrier material for reversing inwardly to other carrier material to which it is adjacent in the carrier when erected and adhesive applied for fixing the said lap extension for joining it to the other side wall free edge when the first and third lines of vertical corner fold for folding fully are finally folded, the first and third lines of vertical corner fold and any further fold, vertical fold, vertical corner fold for reversing inwardly and connecting with a said substantially horizontal line of cutting one of which is above the first or third line of vertical corner fold for folding fully, folded fully for fixing according to the said final folding.

21. A process for erecting an assembled blank according to the invention comprising a substantially rectangular piece of sheet material such as paperboard divided into four side walls by three lines of vertical corner fold, a lap extension hinged to a side wall free edge by a fourth line of vertical corner fold for joining it to the other side wall free edge on assembly, each side wall having a bottom member panel depending from its lower edge at a horizontal line of fold, the first and second bottom member panels adjacent the first line of vertical corner fold for forming a similar structure to that of the third and fourth bottom member panels adjacent the third line of vertical corner fold, a glue lap divided from one of the bottom member panels of each structure by a line of diagonal fold for folding and meeting with the adjacent line of vertical corner fold and the horizontal line of fold, the glue lap inner side able to fold and lie against and be joined to the adjacent bottom member panel outer side after the bottom member panels for folding have been folded to lie against the inner side of their respective side walls and the first line of vertical corner fold has been folded fully for the first bottom member panel to overlie the second bottom member panel and the third line of vertical corner fold has been folded fully for the fourth bottom member panel to overlie the third bottom member panel and the first and fourth free side wall edges have been joined together, connected side wall parts have at least one substantially horizontal cut situated above a said vertical corner fold and its adjacent side walls, the ends of the cut connecting with the lines of two vertical folds which have a further vertical fold therebetween and above the cut, one of said vertical folds providing another such vertical corner fold upon said further vertical fold forming an internal corner by reverse folding the carrier material, means including a second substantially horizontal cut located above at least one of said fully folded vertical corner folds with the carrier material above the second cut being folded to reverse inwardly for forming separation for separating the upper parts of the articles carried and for accommodating a carrying opening therein; characterised in that the free edge of at least one bottom member panel of each one of said similar opposing structures carries a separater forming extension hinging with the bottom member panel at a line of weakness parallel with the said horizontal line of fold and the line of weakness dimensioned to communicate with a said line of weakness of the similar opposing structure when erected and the height of the separater extensions dimensioned to finish below the carrying opening of the inwardly reversing carrier material when the carrier is collapsed, said separater each arranged and adapted for the transmission to it of opposition force through edge engagement between said separater and another said separater for their right-angular displacement relative to their said at least one bottom member panel when said at least one bottom member panel and the bottom member sharing a said diagonal fold together are displaced vertically by their respective side walls of their said similar opposing structure being displaced horizontally and said carrier material folded to reverse inwardly is displaced inwardly contributing stiffness and positioned for co-operating with the separater forming extensions of the bottom which separate the lower parts of the same said articles carried in the erected collapsible carrier and which is erected by moving each said fold for folding fully one toward the other and opened to provide the said displacements, the process comprising, the said horizontal line of fold folded for its depending bottom member panels and separater forming extensions to lie against their respective sidewalls and the diagonal fold of each similar opposing structure folded fully for the glue lap inner side to be able to lie against and be fixed to the adjacent bottom member panel outer side by adhesive applied therebetween and the adhesive applied for fixing any glue flap of a separater of a similar structure to its adjacent separater and adhesive applied for fixing said carrier material for reversing inwardly to other carrier material to which it is adjacent in the carrier when erected and adhesive applied for fixing the said lap extension for joining it to the other side wall free edge when the first and third lines of vertical corner fold for folding fully are finally folded, the first and third lines of vertical corner fold and any further fold, vertical fold, vertical corner fold for reversing inwardly and connecting with a said substantially horizontal line of cutting, one of which is above the first or third line of vertical corner fold for folding fully, folded fully for fixing according to the said final folding; the process for erecting comprising, at least one side wall engaged by its outer surface for the purpose of drawing the side wall away from an opposite side wall, and rightangularly displacing them relative to their adjacent side wall in each similar opposite structure in which the horizontal folds and the bottom member panels are rightangularly displaced by the displacement transmitted by their diagonal fold connection and the separater extensions of the bottom member panels rightangularly displaced relative to their bottom member panels by the transmission to them of opposing force from an engaging separater, and rightangularly displacing said carton material for reversing inwardly between said vertical folds and angularly divided by a said further vertical fold above a vertical corner fold by its fixing to said other carrier material to which it is adjacent in the upper structure of the carrier.

22. A process according to claim 21 for fully erecting the blank into a carton according to the invention for use wherein the sidewalls are pressed to overfold the second and fourth lines of vertical corner fold, the bottom member panels are pressed flat the said horizontal lines of fold pressed rightangular one to the other, the lines of weakness hinging the separaters are overfolded, vertical lines of fold and further vertical lines of fold are overfolded for shaping the carton and enacted substantially simultaneously.

23. A process according to claim 21 for locking the bottom of a carton according to the invention ready for use wherein a tab for forming a nonreturnable stitch cut from the material of the carton material of each similar structure is pressed through an opening of the similar opposing structure simultaneous with the other to form a nonreturnable stitch.

24. A collapsible carrier erected for use made from a blank according to the claim 21.

* * * * *